US010287121B2

(12) United States Patent
Oe et al.

(10) Patent No.: US 10,287,121 B2
(45) Date of Patent: May 14, 2019

(54) SHEET HANDLING APPARATUS AND SHEET HANDLING METHOD

(71) Applicant: GLORY LTD., Himeji-shi, Hyogo (JP)

(72) Inventors: Takahiro Oe, Himeji (JP); Kazuaki Nishimura, Himeji (JP); Youichi Takemura, Himeji (JP)

(73) Assignee: GLORY LTD., Himeji-shi, Hyogo (JP)

( * ) Notice: Subject to any disclaimer, the term of this patent is extended or adjusted under 35 U.S.C. 154(b) by 0 days.

(21) Appl. No.: 15/901,068

(22) Filed: Feb. 21, 2018

(65) Prior Publication Data

US 2018/0244483 A1 Aug. 30, 2018

(30) Foreign Application Priority Data

Feb. 28, 2017 (JP) ..... 2017-036515

(51) Int. Cl.

| | |
|---|---|
| ***B65H 5/28*** | (2006.01) |
| ***B65H 29/51*** | (2006.01) |
| ***B65H 7/20*** | (2006.01) |
| ***B65H 29/70*** | (2006.01) |
| ***B65H 5/36*** | (2006.01) |
| ***B65H 29/00*** | (2006.01) |
| ***G07D 11/00*** | (2019.01) |

(52) U.S. Cl.

CPC ..... *B65H 7/20* (2013.01); *B65H 5/28* (2013.01); *B65H 5/36* (2013.01); *B65H 29/006* (2013.01); *B65H 29/51* (2013.01); *B65H 29/70* (2013.01); *G07D 11/003* (2013.01); *B65H 2301/5125* (2013.01); *B65H 2701/1912* (2013.01)

(58) Field of Classification Search

CPC .. B65H 5/28; B65H 29/70; B65H 2701/1912; B65H 29/51; B65H 29/006

See application file for complete search history.

(56) References Cited

U.S. PATENT DOCUMENTS

| | | | | |
|---|---|---|---|---|
| 5,202,737 | A | 4/1993 | Hollar | |
| 7,494,122 | B2 * | 2/2009 | Spinetti | B65H 5/28 242/324.2 |
| 2012/0004087 | A1 | 1/2012 | Tharayil et al. | |

FOREIGN PATENT DOCUMENTS

| | | | | |
|---|---|---|---|---|
| EP | 2 865 626 | A1 | 4/2015 | |
| JP | 2012-174134 | A | 9/2012 | |
| JP | 2013209215 | A * | 10/2013 | B41J 11/0005 |
| WO | WO-2010032303 | A1 * | 3/2010 | B65H 29/006 |

OTHER PUBLICATIONS

European Search Report (Application No. 18158936.7) (6 pages—dates Jul. 24, 2018).

* cited by examiner

*Primary Examiner* — Luis A Gonzalez

(74) *Attorney, Agent, or Firm* — Renner, Kenner, Greive, Bobak, Taylor & Weber

(57) ABSTRACT

A sheet handling apparatus (for example, banknote handling apparatus 20) includes a storing and feeding unit (25) in which a sheet is stored on a rotary member (for example, drum (25*a*)) by winding the sheet on the rotary member and the sheet wound on the rotary member can be fed from the rotary member, a transport unit (23) that transports the sheet fed from the storing and feeding unit (25), a curl correction mechanism (70) that corrects a curl of the sheet transported by the transport unit (23), and a stacking unit (for example, banknote collection bag (34)) in which the sheet that has passed through the curl correction mechanism (70) is stacked.

15 Claims, 13 Drawing Sheets

SHEET HANDLING APPARATUS AND SHEET HANDLING METHOD

CROSS-REFERENCE TO RELATED APPLICATION

This application claims priority to Japanese Patent Application No. 2017-036515 filed on Feb. 28, 2017, the entire contents of which are incorporated herein by reference.

BACKGROUND OF THE INVENTION

1. Field of the Invention

The present invention relates to a sheet handling apparatus that handles a sheet such as a banknote, and a sheet handling method implemented by the sheet handling apparatus.

2. Description of the Related Art

Various types of sheet handling apparatuses that handle a sheet, for example a paper sheet such as a banknote, are currently in use. Specifically, a paper sheet handling apparatus disclosed in Japanese Patent Application Laid-Open No. 2012-174134 (JP2012-174134A) includes a drum as a storing and feeding unit that stores therein paper sheets and feeds the stored paper sheets one by one. One end of a belt-shaped winding member that winds on the drum a plurality of paper sheets one by one is connected to an outer peripheral surface of the drum. In such a storing and feeding unit, the paper sheets are stored when the winding member is wound on the drum along with the paper sheets, and the stored paper sheets are fed when the winding member is unwound from the drum. In the paper sheet handling apparatus disclosed in JP2012-174134A, when a money deposition process of the paper sheets is performed, the paper sheets inserted from an inserting unit to the inside of a housing from the outside thereof are stored in the storing and feeding unit. In contrast, when a money dispensing process of the paper sheets is performed, the paper sheets fed from the storing and feeding unit are discharged from an ejecting unit to the outside of the housing from the inside thereof. Moreover, in the paper sheet handling apparatus disclosed in JP2012-174134A, a pouch bag, in which the paper sheets are stored, is detachably attached to a device body. When a collection process of the paper sheet is performed, a pouch bag is attached to the device body and the paper sheets fed from the storing and feeding unit are sent to the pouch bag. In this manner, the paper sheets stored in the pouch bag can be collected along with the pouch bag.

SUMMARY OF INVENTION

In the conventional paper sheet handling apparatus disclosed in JP2012-174134A, because the paper sheets are stored in the storing and feeding unit when the winding member is wound on the drum along with the paper sheets, the paper sheet is stored in a curled state in the storing and feeding unit. Therefore, a curl habit of the paper sheet remains even after the paper sheet is fed from the storing and feeding unit. In this case, when the paper sheets are stacked in a stacked manner in the pouch bag, a stacking failure may occur because of the curl habit of the paper sheets.

The present invention has been made in view of the above discussion. One object of the present invention is to provide a sheet handling apparatus and a sheet handling method capable of preventing problems occurring due to the curl of the sheet fed by the storing and feeding unit.

A sheet handling apparatus of the present invention is a sheet handling apparatus including: a storing and feeding unit in which a sheet is stored on a rotary member by winding the sheet on the rotary member and the sheet wound on the rotary member can be fed from the rotary member; a transport unit that transports the sheet fed from the storing and feeding unit; a curl correction mechanism arranged in the transport unit to correct a curl of the sheet transported by the transport unit; and a stacking unit connected to the transport unit and in which the sheet that has passed through the curl correction mechanism is stacked.

The sheet handling apparatus of the present invention may further include a control unit that adjusts a degree of correction of the curl of the sheet by the curl correction mechanism based on at least one of processing contents of the sheet by the sheet handling apparatus; a storing state of the sheet in the storing and feeding unit; and a feature of the sheet fed from the storing and feeding unit.

In the sheet handling apparatus of the present invention, the control unit may adjust the degree of correction of the curl of the sheet by the curl correction mechanism by changing a transport speed of the sheet in the transport unit.

Alternatively, the control unit may adjust the degree of correction of the curl of the sheet by the curl correction mechanism by changing a state of the curl correction mechanism.

In this case, the curl correction mechanism may include a curl correction member capable of contacting with and separating from the sheet transported by the transport unit, and the control unit may change the state of the curl correction mechanism by changing a position of the curl correction member.

Further, the curl correction member may be movable between an operating position at which the curl correction member is nearest to the sheet transported by the transport unit, and a retracted position at which the correction of the curl of the sheet transported by the transport unit is not performed, and the control unit may perform a control to perform the correction of the curl of the sheet and not to perform the correction of the curl of the sheet by moving the curl correction member to one of the operating position and the retracted position.

In the sheet handling apparatus of the present invention, the storing state of the sheet in the storing and feeding unit may include a state based on a distance from a rotation axis of the rotary member to the stored sheet.

In this case, the control unit may increase the degree of correction of the curl of the sheet by the curl correction mechanism when a distance from the rotation axis of the rotary member to the sheet stored in the storing and feeding unit is smaller than a predetermined threshold.

In the sheet handling apparatus of the present invention, the storing state of the sheet in the storing and feeding unit may include a state based on a time duration for which the sheet is stored in the storing and feeding unit.

In the sheet handling apparatus of the present invention, the feature of the sheet may include at least one factor among a denomination, a short edge length, a long edge length, a thickness, and material of the sheet.

In the sheet handling apparatus of the present invention, the stacking unit may be one of: a collecting unit in which can be stacked the sheet that should be collected; an ejecting unit that ejects the sheet outside of a housing from inside thereof; and an escrow unit for bundling in which the sheet that should be bundled by using a bundling medium is temporarily stacked.

In this case, when a collection process of the sheet is performed, the sheet fed to the transport unit from the storing and feeding unit may be sent to the collecting unit after passing the curl correction mechanism.

Further, the collecting unit may be one of a collection bag and a collecting cassette that can be detachably attached to a device body.

The sheet handling apparatus of the present invention may further include an inserting unit for inserting the sheet inside a housing from outside thereof, and the inserting unit may be connected to the transport unit, the sheet inserted from the inserting unit inside the housing from outside thereof may be sent to one of the storing and feeding unit and the stacking unit by the transport unit, and the curl correction mechanism may be arranged in the transport unit at a position between the storing and feeding unit and the stacking unit.

In this case, the sheet handling apparatus of the present invention may further include a control unit that adjusts a degree of correction of the curl of the sheet by the curl correction mechanism based on at least one of processing contents of the sheet by the sheet handling apparatus; a storing state of the sheet in the storing and feeding unit; and a feature of the sheet fed from the storing and feeding unit, and the control unit may adjust the degree of correction of the curl of the sheet by the curl correction mechanism, as the processing contents of the sheet by the sheet handling apparatus, so that the degree of correction of the curl of the sheet is set higher when transporting by the transport unit the sheet fed to the transport unit from the storing and feeding unit than the degree of correction of the curl of the sheet when transporting by the transport unit the sheet inserted from the inserting unit inside the housing.

A sheet handling method of the present invention is a sheet handling method including: feeding a sheet wound on a rotary member of a storing and feeding unit from the rotary member; transporting the sheet fed to a transport unit from the storing and feeding unit; correcting a curl of the sheet transported by the transport unit by using a curl correction mechanism; and stacking the sheet that has passed through the curl correction mechanism in a stacking unit.

In the sheet handling method of the present invention, a degree of correction of the curl of the sheet by the curl correction mechanism may be adjusted based on at least one of processing contents of the sheet; a storing state of the sheet in the storing and feeding unit, and a feature of the sheet fed from the storing and feeding unit.

BRIEF DESCRIPTION OF DRAWINGS

FIG. 7 is a perspective view of a configuration of a banknote collection bag that is to be held by the holding members of the banknote storing mechanism shown in FIG. 5 and the like.

FIG. 8 is a functional block diagram indicating a configuration of a control system in the banknote handling apparatus shown in FIG. 2 and the like.

DESCRIPTION OF EMBODIMENT

Exemplary embodiments in which a banknote handling apparatus that handles a banknote is used as a sheet handling apparatus according to the present invention are explained below in detail. Moreover, in the present embodiment, a money handling machine that includes the banknote handling apparatus and a coin handling apparatus is also explained.

Figure 1:
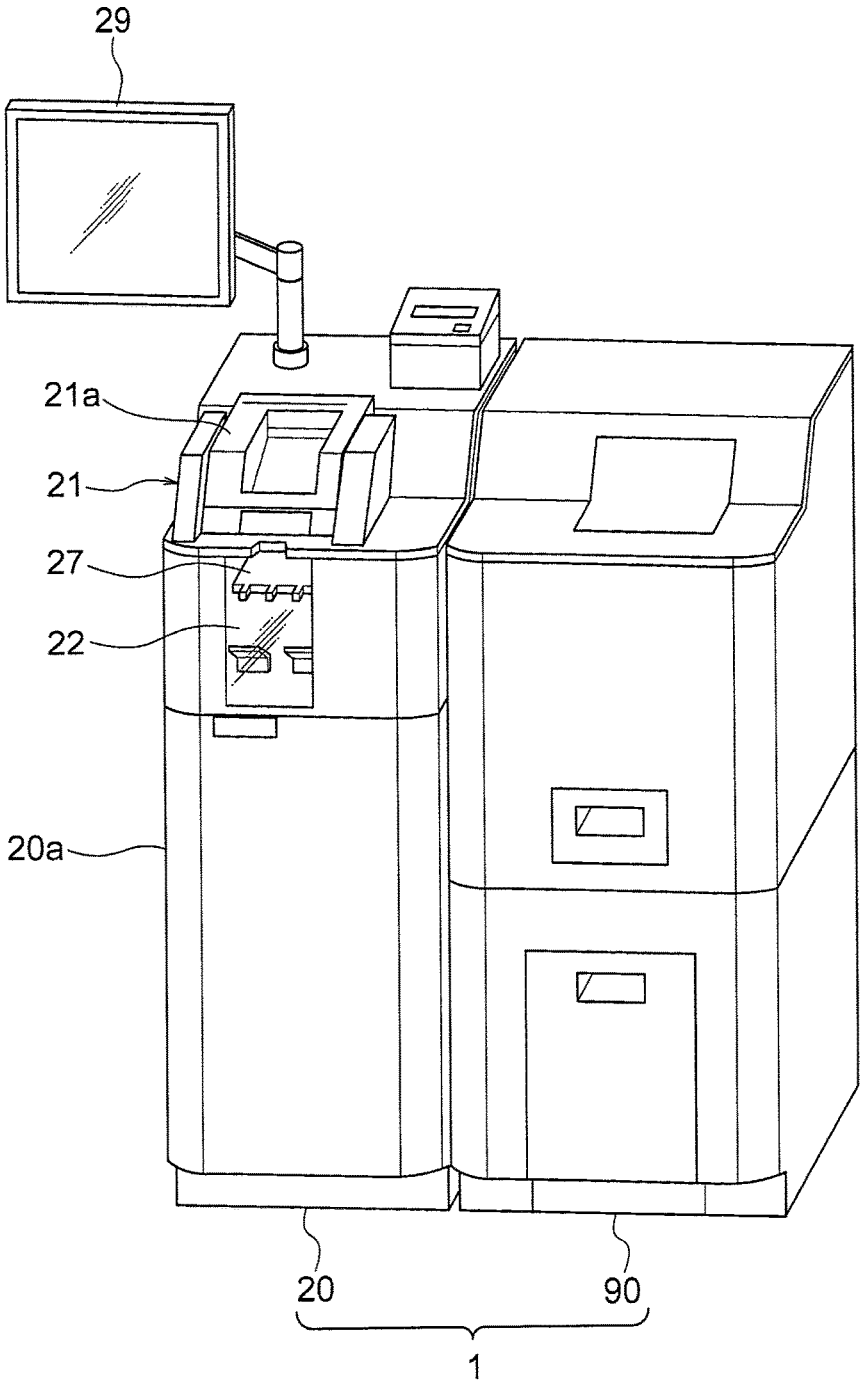
FIG. 1 is a perspective view of an external appearance of a money handling machine according to one embodiment of the present invention.
Figure 2:
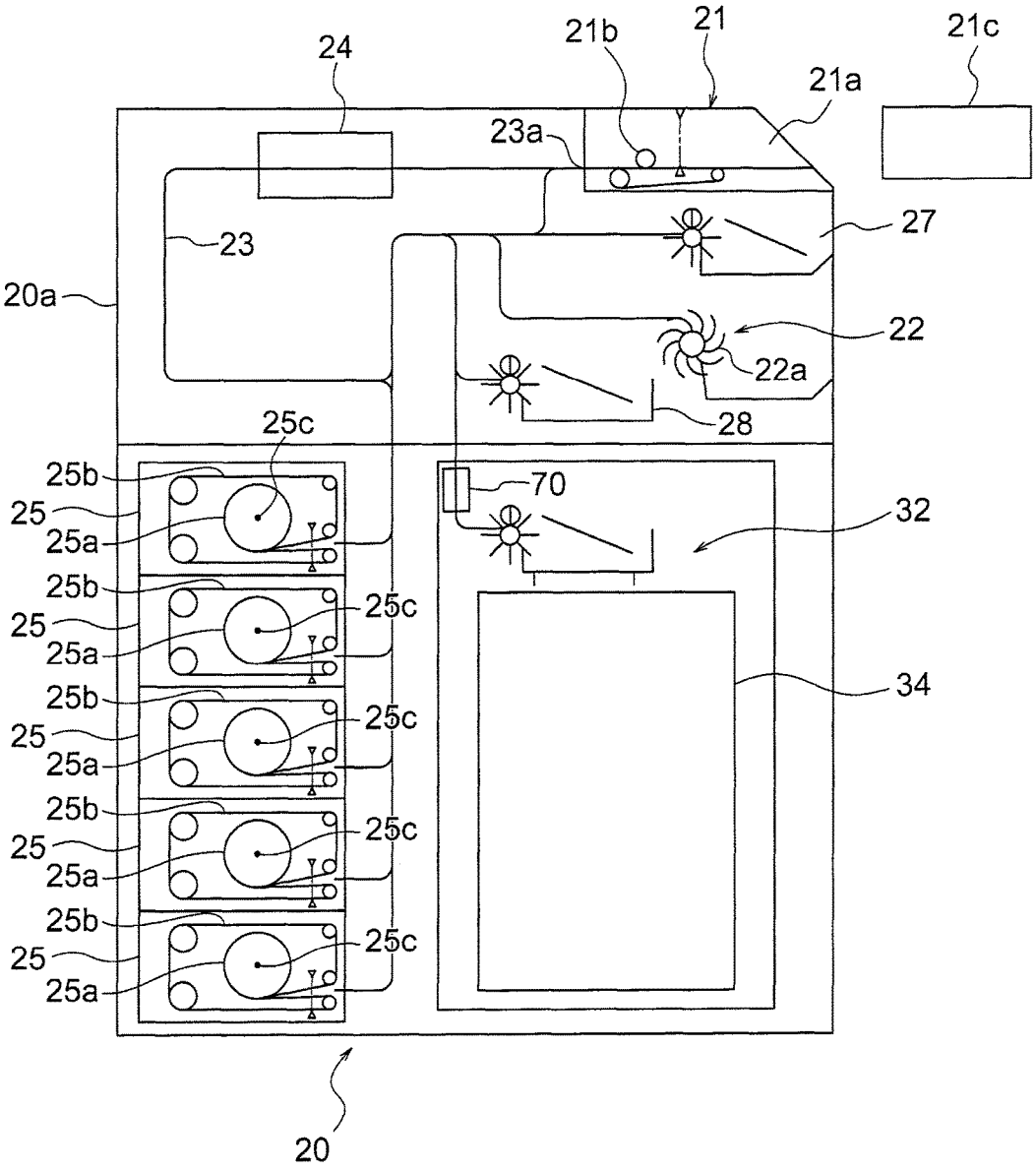
FIG. 2 is a side view of an internal configuration of a banknote handling apparatus in the money handling machine shown in FIG. 1.
Figure 3:
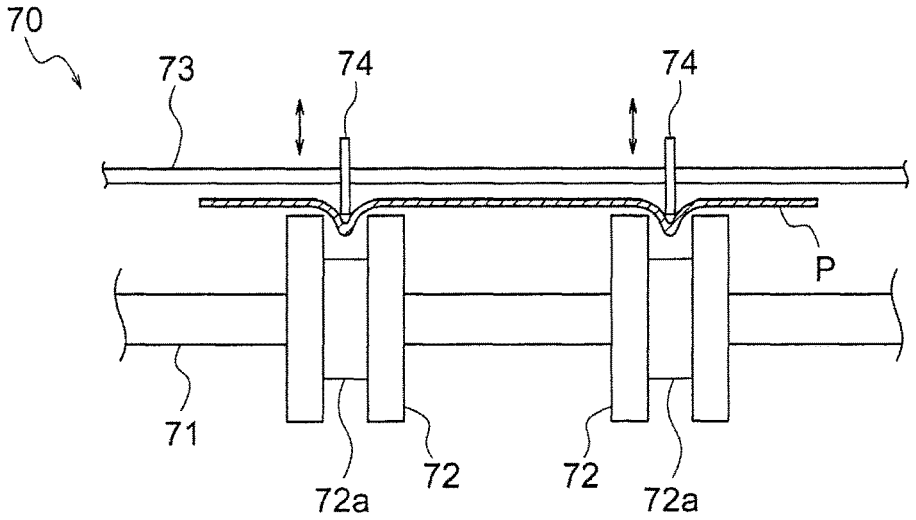
FIG. 3 is a structural diagram of a configuration of a curl correction mechanism arranged in the banknote handling apparatus shown in FIG. 2.
Figure 4A:
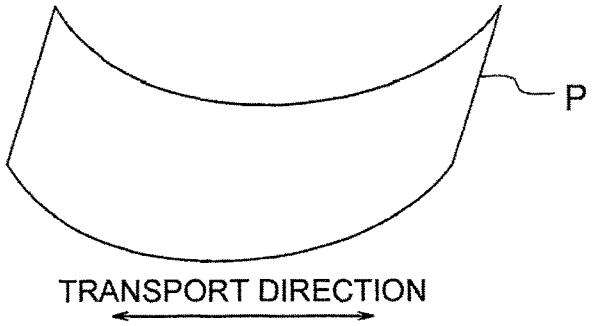
FIG. 4A is a view for explaining a state before curl of a banknote having a curl habit is corrected by the curl correction mechanism shown in FIG. 3.
Figure 4B:
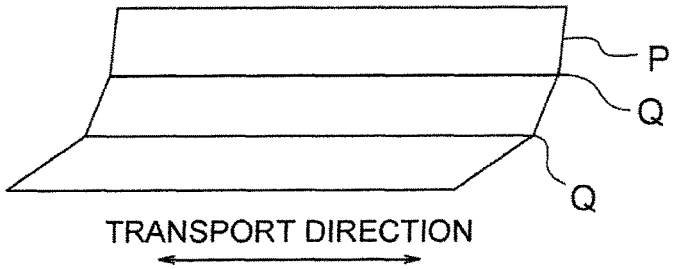
FIG. 4B is a view for explaining a state after the curl of the banknote having the curl habit is corrected by the curl correction mechanism shown in FIG. 3.
Figure 14:
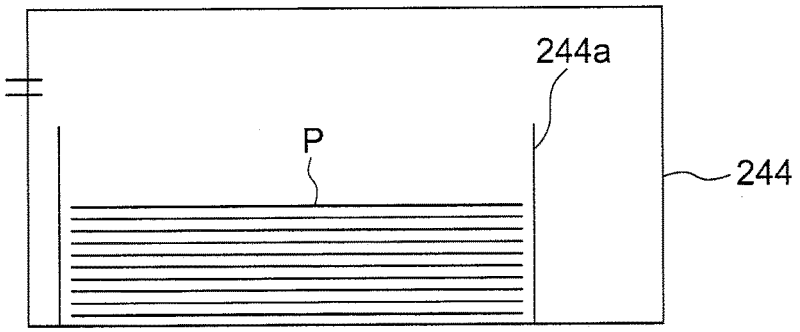
FIG. 14 is a structural diagram of a configuration of a banknote storing cassette of the banknote handling apparatus of the example shown in FIG. 13.
Figure 15:
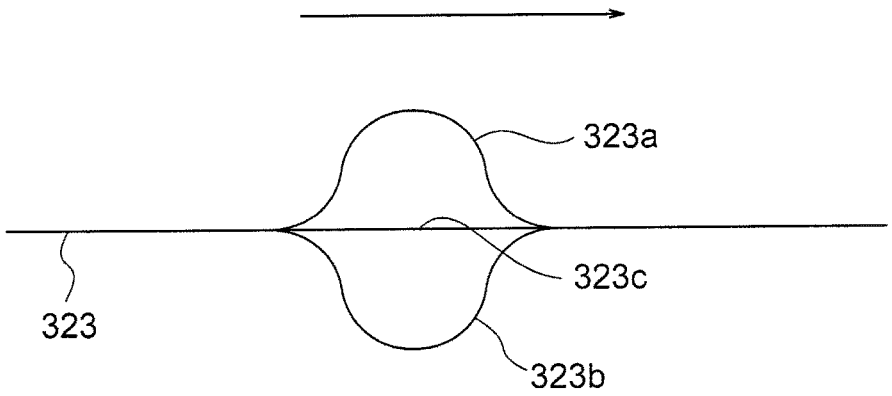
FIG. 15 is a view for explaining a state when the curl of the banknote is corrected by a shape of a transport unit.

FIGS. 1 to 15 are views of the banknote handling apparatus according to the present embodiment and the money handling machine including this banknote handling apparatus. Among them, FIG. 1 is a perspective view of an external appearance of the money handling machine according to one embodiment of the present invention, and FIG. 2 is a structural diagram of an internal configuration of the banknote handling apparatus in the money handling machine shown in FIG. 1. FIG. 3 is a structural diagram of a configuration of a curl correction mechanism arranged in the banknote handling apparatus shown in FIG. 2. FIGS. 4A and 4B are respectively views for explaining a state before and after the curl of the banknote having a curl habit is corrected by the curl correction mechanism shown in FIG. 3. FIGS. 5 to 8 are structural diagrams of a configuration of a banknote storing mechanism in the banknote handling apparatus shown in FIG. 2. FIGS. 9 to 13 are side views of various other examples of an internal configuration of the banknote handling apparatus according to the present embodiment. FIG. 14 is a structural diagram of a configuration of a banknote storing cassette of the banknote handling apparatus of the example shown in FIG. 13. FIG. 15 is a view for explaining a state when the curl of the banknote is corrected by a shape of a transport unit. In FIGS. 3, 4A, 4B, and 14, the banknote handled by the banknote handling apparatus according to the present embodiment is shown with a reference letter P. Moreover, in FIG. 4B, a habit such as folds and the like made in the banknote by the curl correction mechanism is shown with a reference letter Q.

At first, a configuration of a money handling machine 1 according to one embodiment of the present invention is explained by referring to FIG. 1. Generally, a shop such as a supermarket is divided into a front area in which a salesclerk deposits and/or dispenses money actually exchanged with the customer, and a backyard area in which the money and the products used in the front area are managed. One or more money settlement machines (e.g., money change machine) are installed in the front area. The money handling machine 1 shown in FIG. 1 is installed in the backyard area. The money settlement machine is operated by a salesclerk. Cash settlement process between the salesclerk and a customer is carried out by using the money settlement machine. For example, the money settlement machine is used to deposit the money received from the customer and to dispense a change to be returned to the customer. Moreover, the money handling machine 1 is used to dispense a change fund for loading into the money settlement machine and to deposit proceeds of sales collected from the money settlement machine. By using a money storing cassette (specifically, a later-explained banknote storing cassette 21*c*) that can be detachably attached to each of the money settlement machine and the money handling machine 1, the money can be exchanged between the money settlement machine and the money handling machine 1. Note that, the money stored in the money storing cassette cannot be taken out when the money storing cassette is in the detached state from the money settlement machine and the money handling machine 1.

As shown in FIG. 1, the money handling machine 1 installed in the backyard area includes a banknote handling apparatus 20 and a coin handling apparatus 90. The banknote handling apparatus 20 is used to dispense banknotes to be loaded in the money settlement machine installed in the front area, and to deposit banknotes collected from the money settlement machine. The coin handling apparatus 90 is used to dispense coins to be loaded in the money settlement machine installed in the front area, and to deposit coins collected from the money settlement machine.

Subsequently, the configuration of the banknote handling apparatus 20 is explained by using FIGS. 1 and 2. A side surface on the right side of a later-explained housing 20*a* in FIG. 2 is a front surface side of a banknote handling apparatus 20 (that is, a front side of the banknote handling apparatus 20 when the apparatus is seen from the front side shown in FIG. 1), and the left direction in FIG. 2 is a depth direction of the housing 20*a*.

As shown in FIG. 1, the banknote handling apparatus 20 includes the housing 20*a*, an inserting unit 21, an ejecting unit 22, and an operation/display unit 29. A banknote receiving unit 21*a* is detachably attached to the inserting unit 21. The banknote receiving unit 21*a* receives banknotes from the outside of the banknote handling apparatus 20 and by using a banknote feeding mechanism 21*b* feeds the banknotes one by one inside the housing 20*a*. The banknote receiving unit 21*a* is used when an operator (that is, the salesclerk) manually deposits the banknotes in the banknote handling apparatus 20. The above-mentioned money storing cassette (specifically, the banknote storing cassette 21*c* (see FIG. 2)) can be mounted in the inserting unit 21 instead of the banknote receiving unit 21*a*. When the banknote storing cassette 21*c* is mounted in the inserting unit 21, the banknotes in the banknote storing cassette 21*c* are fed one by one inside the housing 20*a* by a feeding mechanism arranged in the banknote storing cassette 21*c*. The ejecting unit 22 stacks in a stacked manner the banknote fed from a later-explained storing and feeding unit 25. The banknotes stacked in the ejecting unit 22 can be accessed from the outside of the housing 20*a*. In the banknote handling apparatus 20 according to the present embodiment, the ejecting unit 22 functions as a stacking unit according to present invention.

The operation/display unit 29 displays various information such as storing states of the banknote and the coin in the money handling machine 1. Moreover, the operator can input data by using the operation/display unit 29. The operation/display unit 29 is constituted by, for example, a touch screen-type display, and the like. Note that, the operation/display unit 29 is arranged in one of the banknote handling apparatus 20 and the coin handling apparatus 90; however, the operation/display unit 29 is shared by both of them to display the information.

As shown in FIG. 2, inside the housing 20*a* of the banknote handling apparatus 20 is arranged a transport unit 23 for transporting the banknotes one by one. The above-mentioned inserting unit 21 is connected to one end 23*a* of the transport unit 23. When the banknote receiving unit 21*a* is mounted in the inserting unit 21, the banknote fed from the banknote receiving unit 21*a* is transported by the transport unit 23 through the end 23*a* of the transport unit 23.

As shown in FIG. 2, a recognition unit 24 is arranged in the transport unit 23. The recognition unit 24 performs recognition such as a denomination, a fitness, an authenticity of the banknote transported by the transport unit 23. Specifically, the recognition unit 24 includes an image sensor, a magnetic sensor, a thickness sensor, and the like. More particularly, for example, the image sensor captures an image of the banknote transported by the transport unit 23, and recognition of information about the banknote is performed based on the captured image of the banknote. Moreover, based on the captured image, a detection result obtained by the magnetic sensor, and the like, a short edge length (that is, a length of a short side of the banknote) of the banknote transported by the transport unit 23, a long edge length (that is, a length of a long side of the banknote), material (paper, polymer, and the like), and a printing state (for example, excess or deficiency of ink used for printing the banknote), and the like, can be detected. Moreover, for example, when the banknote transported by the transport unit 23 is a banknote including a plurality of material, such as a hybrid banknote (for example, a banknote in which polymer film is stuck on a part of a paper banknote, a banknote formed by sandwiching liner-shaped polymer film running parallel to the short side direction of the banknote between a pair of paper strips), the recognition unit 24 detects a position, a width, and the like of the polymer film in addition to the denomination, the fitness, the authenticity, the dimensions, the materials, and the like. The recognition unit 24 also detects a thickness of the banknote passing the recognition unit 24. Moreover, when the banknote is a banknote in which a metal wire and the like is embedded to prevent a fraudulent activity (for example, forgery of banknote, and the like), the recognition unit 24 also detects a position, number, a width, and the like of the embedded metal wire in addition to the denomination, the fitness, the authenticity, the dimensions, the materials, and the like. The information about the banknote recognized by the recognition unit 24 is sent to a later-explained control unit 50. Accordingly, the recognition unit 24 recognizes (detects) the features of the banknote.

In an alternative configuration, the information that the denomination is associated with the material, the position and the width of the polymer film, and the like of the banknote can be previously stored in a later-explained memory 52. This allows the control unit 50 to determine the material, the position and the width of the polymer film, and the like of the banknote based on the denomination of the banknote recognized by the recognition unit 24.

As shown in FIG. 2, the banknote handling apparatus 20 is provided with an outside reject unit 27 and an inside reject unit 28. Among the banknotes inserted in the housing 20*a* from the inserting unit 21, a banknote that is recognized by the recognition unit 24 as not being a normal banknote is sent as a reject banknote to the outside reject unit 27 by the transport unit 23. Such a reject banknote is ejected outside the banknote handling apparatus 20 by using the outside reject unit 27. On the other hand, a reject banknote that cannot be ejected outside the banknote handling apparatus 20 is sent to the inside reject unit 28 by the transport unit 23. Such a reject banknote is stored in the inside reject unit 28. An operator such as the salesclerk who does not have management powers and authorities cannot take out the banknote present in the inside reject unit 28.

A plurality of the storing and feeding units 25 is arranged in the housing 20*a*. Each of the storing and feeding units 25 is connected to the transport unit 23. Each of the storing and feeding units 25 stores therein a banknote according to a denomination of the banknote. More particularly, based on the recognition result obtained in the recognition unit 24, the banknote fed to the transport unit 23 from the inserting unit 21 is sent by the transport unit 23 to one of the storing and feeding units 25 according to the denomination of the banknote. It is allowable to store a banknote of a foreign currency and the like that is not assigned to any of the storing and feeding units 25 in one of the storing and feeding units 25. Moreover, it is allowable to store an overflow banknote, which is a banknote that cannot be stored in the storing and feeding unit 25 because this storing and feeding unit 25 to which is assigned banknotes of a certain denomination is full, in another storing and feeding unit 25. In the storing and feeding unit 25 in which the foreign currency banknotes and the overflow banknotes are stored, the banknotes will be stored in a state in which the denominations and the like are mixed.

Each of the storing and feeding units 25 can feed the banknotes stored in the storing and feeding unit 25 one by one to the transport unit 23. Specifically, each of the storing and feeding unit 25 includes a substantially cylindrical drum 25*a* (that is, a rotary member) adapted to rotate around a rotation axis 25*c*. One end of a belt-shaped winding member 25*b* that winds on the drum a plurality of banknotes one by one is connected to an outer peripheral surface of the drum 25*a*. The banknotes are stored when the winding member 25*b* is wound on the drum 25*a* along with the banknotes, and the stored banknotes are fed from the drum 25*a* when the winding member 25*b* is unwound from the drum 25*a*. That is, the banknotes are stored in a curled state in each of the storing and feeding units 25. Therefore, the banknote fed from each of the storing and feeding units 25 to the transport unit 23 has a curl habit. More particularly, when the transport unit 23 is adapted to transport the banknotes in a direction that is parallel to the long side of the banknotes, the banknotes are stored in the storing and feeding unit 25 such that the long side of the banknote substantially coincides with a circumferential direction of the drum 25*a*. Therefore, the banknote fed from the storing and feeding unit 25 to the transport unit 23 has a curl habit along the long side of the banknote (see FIG. 4A). A banknote having the curl habit is, for example, as shown in FIG. 4A, a banknote that remains in a bent (curled) state unless some external force is applied thereto. Moreover, the curl habit of the banknote can be corrected only by applying the external force to the banknote. Moreover, a strong curl habit of the banknote means that, it is necessary to apply a stronger external force to the banknote, or to apply the external force for a longer time to the banknote to correct the curl habit of the banknote. As explained below, a winding strength by which the winding member 25*b* is wound around the drum 25*a* in each of the storing and feeding unit 25 can be adjusted by the control unit 50.

In the banknote handling apparatus 20 according to the present embodiment, a banknote storing mechanism 32 (see FIG. 2) is arranged inside the housing 20*a*. A later-explained banknote collection bag 34 for storing therein the banknotes in a stacked state is detachably attached to the banknote storing mechanism 32. The banknotes sent to the banknote storing mechanism 32 from the storing and feeding unit 25 via the transport unit 23 are stored in the stacked manner in the banknote collection bag 34. The banknote collection bag 34 functions as a collecting unit (stacking unit) according to present invention.

The banknote of a denomination that is not assigned to any of the storing and feeding unit 25, and an overflow banknote that cannot be stored in the storing and feeding unit 25 corresponding to the denomination of this banknote because the storing and feeding unit 25 is full are also stored in the banknote collection bag 34. By taking the banknote collection bag 34 out of the banknote storing mechanism 32, the banknotes stored in the banknote collection bag 34 can be collected from the banknote handling apparatus 20. A configuration of the banknote storing mechanism 32 will be explained in detail later.

In the banknote handling apparatus 20 according to the present embodiment, a curl correction mechanism 70 that corrects the curl of the banknote transported by the transport unit 23 is arranged in the transport unit 23 near the banknote storing mechanism 32. As shown in FIG. 3, the curl correction mechanism 70 includes a pair of lower rollers 72 arranged rotatably on a position-fixed axis 71, and a pair of upper rollers 74 (that is, curl correction member) arranged rotatably on an axis 73 that is movable in an up-down direction in FIG. 3 with respect to the axis 71. The lower rollers 72 and the upper rollers 74 are driven by a not-shown driving motor. Each of the lower rollers 72 has a groove 72*a* near a center in a width direction of the lower roller 72. The upper rollers 74 and the lower rollers 72 are arranged such that the upper roller 74 opposes the groove 72*a* of the corresponding lower roller 72 across a transport path of the banknote. Moreover, a width of the groove 72*a* in an axial direction of the axis 71 (that is, left-right direction in FIG. 3) is larger than a width of the upper roller 74. Therefore, in the curl correction mechanism 70, a partial area of the banknote (marked with the reference letter P in FIG. 3) passing through the curl correction mechanism 70 can be pushed with the upper rollers 74 inside the grooves 72*a* of the lower rollers 72. Accordingly, the curl correction mechanism 70 can apply a habit such as folds that is different from the curl habit (see FIG. 4B) to the banknote fed to the transport unit 23 from the storing and feeding unit 25 thereby correcting the curl of the banknote.

More particularly, the banknote fed to the transport unit 23 from the storing and feeding unit 25 has the curl habit (that is, the curl habit along a transport direction (long side) of the banknote) as shown in FIG. 4A, and the banknote is transported in the left-right direction (that is, a direction that is parallel to the transport direction (long side) of the banknote) in FIG. 4A. The curl correction mechanism 70 corrects the curl of the banknote by applying a habit, such as folds, to the banknote along the transport direction (long side) of the banknote. Specifically, the curl of the banknote having the curl habit as shown in FIG. 4A is corrected by applying with the curl correction mechanism 70 the habit (marked with the reference letter Q in FIG. 4B), such as folds, as shown in FIG. 4B. More specifically, the banknote transported by the transport unit 23 is transported in a state in which the banknote is pinched by various components of the transport unit 23. Therefore, regardless of whether the banknote transported by the transport unit 23 has the curl habit, a shape of the banknote transported by the transport unit 23 is flat when seen from a side (that is, when seen from a direction that is orthogonal to the paper surface of FIG. 2). When the banknote is pinched such that the banknote is flat when seen from the side and is transported in the flat state by the transport unit 23, by applying the habit of folds and the like along the transport direction (long side) of the banknote, stiffness against bending in the transport direction of the banknote can be increased. Accordingly, the curl correction mechanism 70 can correct the curl habit of the banknote.

The curl correction mechanism 70 includes a movement mechanism 75 (see FIG. 8) that integrally moves the upper rollers 74 in a direction of an arrow shown in FIG. 3 (that is, up-down direction in FIG. 3). More particularly, the movement mechanism 75 can move the upper rollers 74 in the up-down direction in FIG. 3 at a desirable position between an operating position at which the upper rollers 74 are nearest to the banknote making it possible to correct the curl of the banknote and a retracted position at which the correction of the curl of the banknote is not performed. Accordingly, it is possible to control whether to correct the curl of the banknote passing through the curl correction mechanism 70.

It is allowable to adopt a configuration in which a position in the up-down direction in FIG. 3 of each of the upper rollers 74 can be adjusted by using the movement mechanism 75. In this configuration, the curl correction mechanism 70 can adjust a strength of the habit (marked with the reference letter Q in FIG. 4B) such as folds to apply to the banknote.

In the banknote handling apparatus 20 according to the present embodiment, a degree of correction of the curl of the banknote by the curl correction mechanism 70 can be adjusted by adjusting a transport speed of the banknote transported by the transport unit 23. More particularly, when the transport speed of the banknote by the transport unit 23 is slow, the banknote transported on the transport unit 23 takes a longer time to pass through the curl correction mechanism 70. In other words, by setting the transport speed of the banknote by the transport unit 23 slow, the correction of the curl of the banknote by the curl correction mechanism 70 can be performed for a longer time. Thus, by setting the transport speed of the banknote by the transport unit 23 slow, the degree of correction of the curl of the banknote by the curl correction mechanism 70 can be increased.

Figure 5:
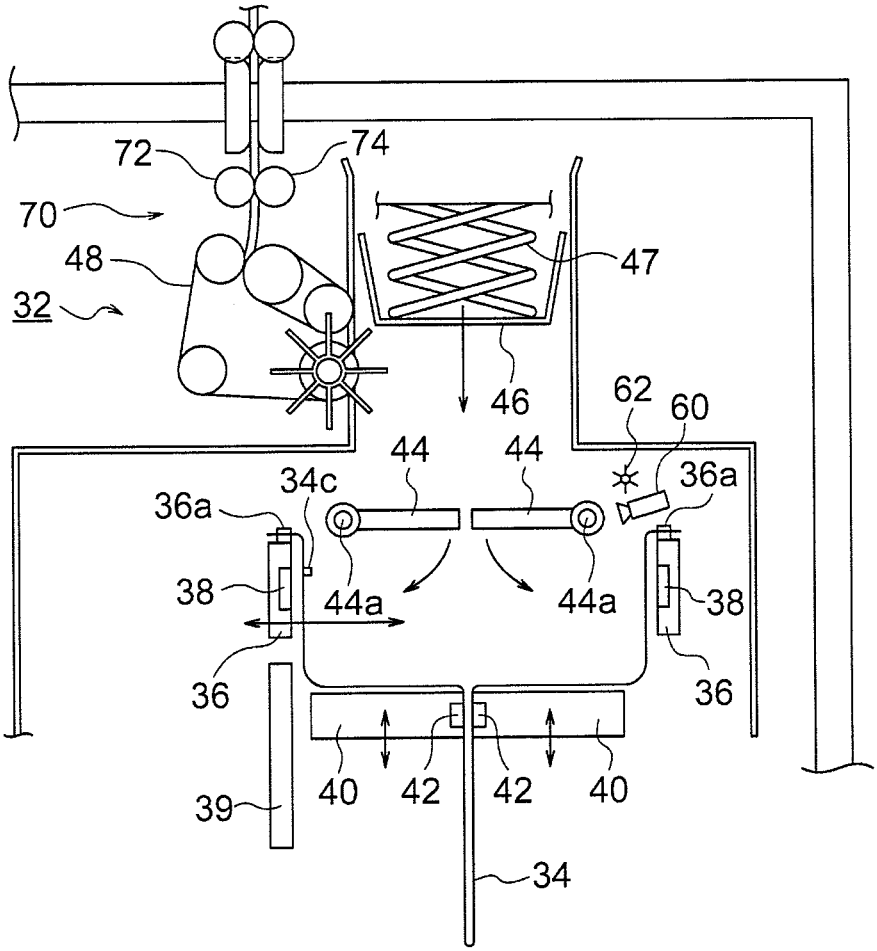
FIG. 5 is a side view of a detailed configuration of a banknote storing mechanism in the banknote handling apparatus shown in FIG. 2.
Figure 6:
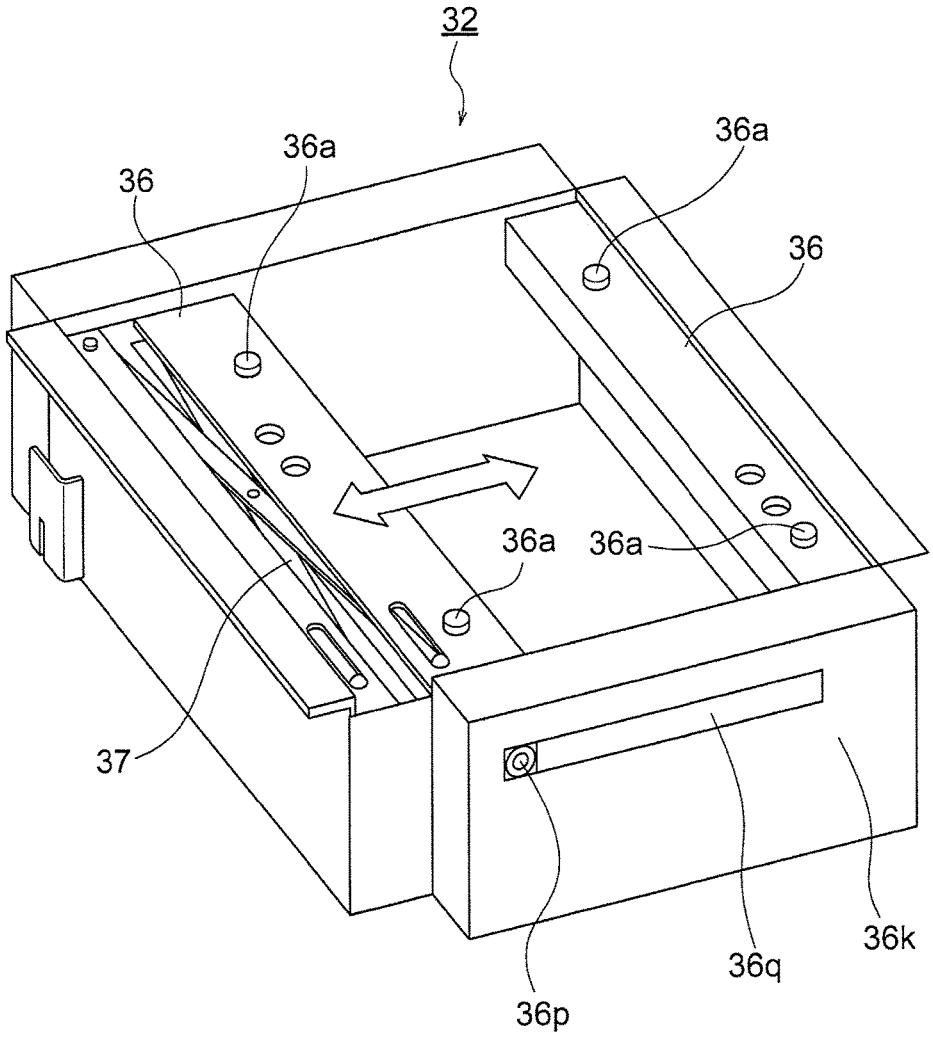
FIG. 6 is a perspective view of a configuration including a pair of holding members and the like in the banknote storing mechanism shown in FIG. 5.
Figure 7:
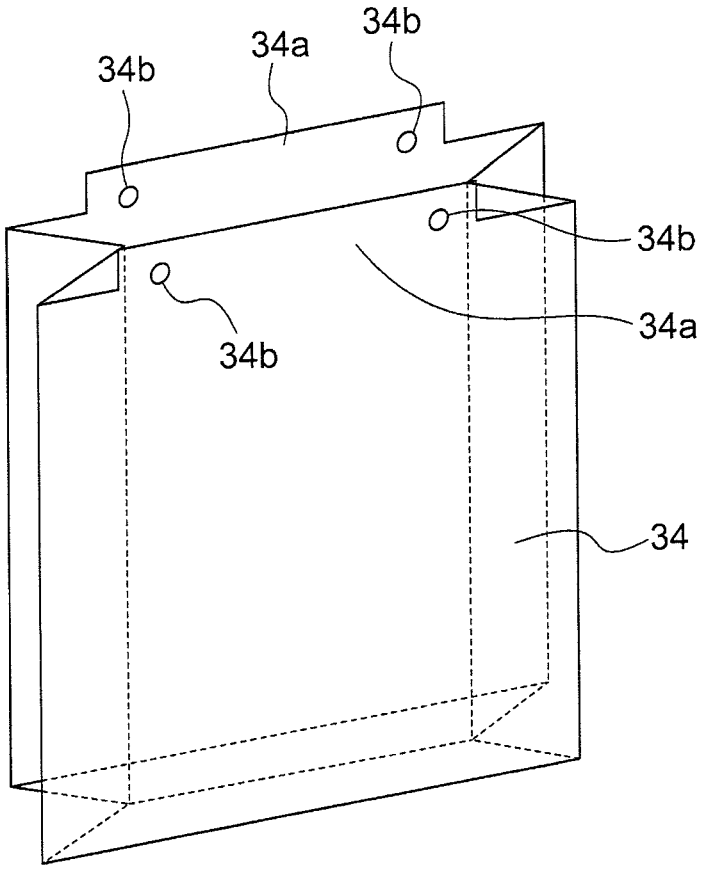

Subsequently, a detailed configuration of the banknote storing mechanism 32 in the banknote handling apparatus 20 is explained by using FIGS. 5 to 7. FIG. 5 is a side view of a detailed configuration of the banknote storing mechanism 32. FIG. 6 is a perspective view of a configuration including a pair of holding members 36 and the like in the banknote storing mechanism 32 shown in FIG. 5. FIG. 7 is a perspective view of a configuration of the banknote collection bag 34 that is to be held by the holding members 36 of the banknote storing mechanism 32 shown in FIG. 5 and the like.

As shown in FIG. 5, a banknote feeding unit 48 is constituted by a combination of rollers and belts. The banknote feeding unit 48 causes the banknote sent to the banknote storing mechanism 32 by the transport unit 23 to be sent one by one to escrow units 44 and stacked on the escrow units 44. One escrow unit 44 is arranged on the right side and another escrow unit 44 is arranged on the left side. A base end of each of the escrow units 44 is rotatably supported by an axis 44*a* such that the escrow unit 44 can rotate in a lower direction (that is, in a direction of a curved arrow in FIG. 5) around the axis 44*a*. One stage 40 is arranged on the right side and another stage 40 is arranged on the left side. Each of the stages 40 is movable in the up-down direction and left-right direction in FIG. 5. A gap is secured between the pair of stages 40. A portion of the banknote collection bag 34 held by the holding members 36 passes through the gap between the stages 40 and protrudes downward. Each of the stages 40 is driven by a stage driving unit 41 (see FIG. 8) such as an electric actuator. Each of the stages 40 includes a heating member 42. Before the banknote collection bag 34 is taken out of the banknote storing mechanism 32, in a state in which one stage 40 (for example, the stage 40 on the left side in FIG. 5) is moved towards the other stage 40 (for example, the stage 40 on the right side in FIG. 5) and both the stages 40 are in contact with each other, heat sealing of a bottom part of the banknote collection bag 34 is performed by applying heat to a part near the bottom part of the banknote collection bag 34 with the heating members 42.

As shown in FIG. 6, the left holding member 36 among the pair of left and right holding members 36 is provided with a pantograph 37. The left holding member 36 can be moved towards the right holding member 36 by the pantograph 37 so that the two holding members 36 contact each other. More particularly, guide pins 36*p* are arranged at ends of the left holding member 36. Elongated through-holes 36*q* are formed in frames 36*k* that support the holding members 36, and the guide pins 36*p* are guided in the elongated through-holes 36*q*. The elongated through-holes 36*q* extend horizontally in the frames 36*k*. When the pantograph 37 extends, because the guide pins 36*p* arranged in the left holding member 36 are guided along the elongated through-holes 36*q*, the left holding member 36 moves toward the right holding member 36.

As shown in FIG. 6, two pins 36*a* are arranged on a top surface of each of the left and right holding members 36. As shown in FIG. 7, the banknote collection bag 34 to be held by the holding members 36 has a pair of protruding parts 34*a* near the opening thereof (that is, near an upper edge of the banknote collection bag 34), and each of the protruding parts 34*a* is provided with a pair of holes 34*b*. When the banknote collection bag 34 is to be held by the holding members 36, the pins 36*a* of the holding members 36 are inserted in the corresponding holes 34*b* formed in the corresponding protruding parts 34*a* of the banknote collection bag 34. As a result, the protruding parts 34*a* are held by the holding members 36.

Moreover, as shown in FIG. 5, a pushing plate 46 is arranged above the pair of escrow units 44. A pantograph 47 is arranged above the pushing plate 46. When the pantograph 47 expands downward, the pushing plate 46 is moved downward from its position shown in FIG. 5. Because of the downward movement of the pushing plate 46 from its position shown in FIG. 5, when the banknotes escrowed on the escrow units 44 are stored into the banknote collection bag 34, any banknote that may have remained on the escrow units 44 can be pushed toward the banknote collection bag 34.

As shown in FIG. 5, a pushing lever 39 is arranged below the left holding member 36 of the pair of holding members 36. Because of the pushing lever 39, the banknotes stored in the banknote collection bag 34 held by the pair of holding members 36 are pushed toward one side (specifically, to the right side in FIG. 5) in the banknote collection bag 34. More particularly, the pushing lever 39 is moved to the right side from its state shown in FIG. 5 by a pushing lever driving unit 39*a* (see FIG. 8). The pushing lever driving unit 39*a* is constituted by a pantograph, an electric actuator, and the like.

In the banknote storing mechanism 32, an image capturing unit 60, such as a camera, for capturing an image of an inner wall part of the banknote collection bag 34 is arranged near the opening of the banknote collection bag 34 held by the holding members 36. Moreover, a mark 34*c* (see FIG. 5) is arranged on the inner wall part near the opening of the banknote collection bag 34 held by the holding members 36. An image of this mark 34*c* is captured by the image capturing unit 60. Moreover, a light source 62 that emits a light on the inner wall part of the banknote collection bag 34 held by the holding members 36 is arranged near the image capturing unit 60. By emitting the light on the inner wall part of the banknote collection bag 34 from the light source 62, a clear image of the mark 34*c*, which is arranged on the inner wall part near the opening of the banknote collection bag 34, can be captured by the image capturing unit 60.

In the banknote storing mechanism 32, an operation when the banknote sent to the banknote storing mechanism 32 by the transport unit 23 is stored in the banknote collection bag 34 held by the pair of holding members 36 is explained in detail below.

The banknote sent to the banknote storing mechanism 32 by the transport unit 23 is sent by the banknote feeding unit 48 on the pair of left and right escrow units 44 and is stacked on those escrow units 44. When a predetermined number of the banknotes are stacked on the escrow units 44, each of the escrow units 44 rotates below (that is, in the direction of the curved arrow shown in FIG. 5) around the axis 44*a* provided at the base end thereof. The banknotes stacked on the escrow units 44 fall from the escrow units 44 by own weight, and are stored in the banknote collection bag 34. When the banknotes fall from the escrow units 44 and are stored in the banknote collection bag 34, the stages 40 are moved downward by the stage driving unit 41 whereby a storage space for the subsequent banknotes that may be sent from the escrow units 44 to the banknote collection bag 34 is formed in the banknote collection bag 34. In the present embodiment, when sending the banknotes in the banknote collection bag 34 held by the holding members 36 to store the banknotes in the banknote collection bag 34, the control unit 50 controls the pantograph 47 to push with the pushing plate 46 the banknote escrowed on the escrow units 44 into the banknote collection bag 34. Accordingly, even if a banknote remains on the escrow units 44, this banknote can be caused to fall from the escrow units 44 and stored in the banknote collection bag 34.

When the banknote is stored in the banknote collection bag 34 held by the holding members 36, an image of the mark 34*c* arranged on the inner wall part of the banknote collection bag 34 is always captured by the image capturing unit 60. When the banknotes of the predetermined quantity are stored in the banknote collection bag 34, the mark 34*c* is blocked by the banknotes stored in the banknote collection bag 34 and does not appear in the image captured by the image capturing unit 60. When this happens, the control unit 50 determines that the banknote collection bag 34 is full or nearly full. Thus, because a top surface of the banknotes stored in the banknote collection bag 34 can be detected based on the image captured by the image capturing unit 60, as explained below, when the left holding member 36 moves towards the right holding member 36 and an opening of the banknote collection bag 34 is heat sealed by heating members 38, it is possible to prevent that the banknotes stored in the banknote collection bag 34 are pinched by the holding members 36, and a not-sealed portion occurs in the opening of the banknote collection bag 34. Note that, it is allowable to adopt a configuration in which the control unit 50 determines that the banknote collection bag 34 is full or nearly full based on the pushing operation of the escrow units 44 by the pushing plate 46. More particularly, when the banknote collection bag 34 is full or nearly full, the banknotes stored in the banknote collection bag 34 will exist inside a movement area (see the curved arrows in FIG. 5) of the escrow units 44. In this case, because free ends of the escrow units 44 will touch the banknotes stored in the banknote collection bag 34 when the escrow units 44 are pushed by the pushing plate 46 into the banknote collection bag 34, the escrow units 44 can no longer be pushed in the banknote collection bag 34. Based on this fact, it can be determined whether the banknote collection bag 34 is full or nearly full. Note that, it is allowable to adopt a configuration in which the escrow units 44 are arranged at a position that is above their position shown in FIG. 5 such that the banknotes stored in the banknote collection bag 34 do not exist in the movement area of the escrow units 44, and the control unit 50 determines whether the banknote collection bag 34 is full or nearly full based on the pushing operation of the pushing plate 46. More particularly, when the banknote collection bag 34 is full or nearly full, when pushing the banknotes escrowed on the escrow units 44 with the pushing plate 46 in the banknote collection bag 34, the distance for which the pushing plate 46 can be moved toward the banknote collection bag 34 will be shorter as compared to this distance when the banknote collection bag 34 is not full or nearly full. Based on this fact, it can be determined whether the banknote collection bag 34 is full or nearly full.

When it is determined that the banknote collection bag 34 is full or nearly full, the banknote collection bag 34 is taken out of the banknote storing mechanism 32. However, before the banknote collection bag 34 is taken out of the banknote storing mechanism 32, the pushing lever 39 is moved by the pushing lever driving unit 39*a* toward the right direction in FIG. 5, and the banknotes stored in the banknote collection bag 34 are pushed by the pushing lever 39 toward one side in the banknote collection bag 34. Then, when the pushing lever 39 returns to its original position, a gap is formed between the left inner wall part of the banknote collection bag 34 and the banknotes that have been pushed to the one side in the banknote collection bag 34. After the banknotes stored in the banknote collection bag 34 held by the holding members 36 are pushed by the pushing lever 39 toward the one side (specifically, the right side in FIG. 5) in the banknote collection bag 34, the left stage 40 moves toward the right stage 40 in FIG. 5 and contacts the right stage 40, and the heat sealing of the bottom part of the banknote collection bag 34 is performed by applying heat to the part near the bottom part of the banknote collection bag 34 with the heating members 42. Then, the left holding member 36 moves toward the right holding member 36 in FIG. 5 and contacts the right holding member 36, and the heat seal sealing of the opening of the banknote collection bag 34 is performed by applying heat to the part near the opening of the banknote collection bag 34 with the heating members 38. Accordingly, the operator can withdraw the opening and the bottom part sealed banknote collection bag 34 from the banknote storing mechanism 32.

Figure 8:
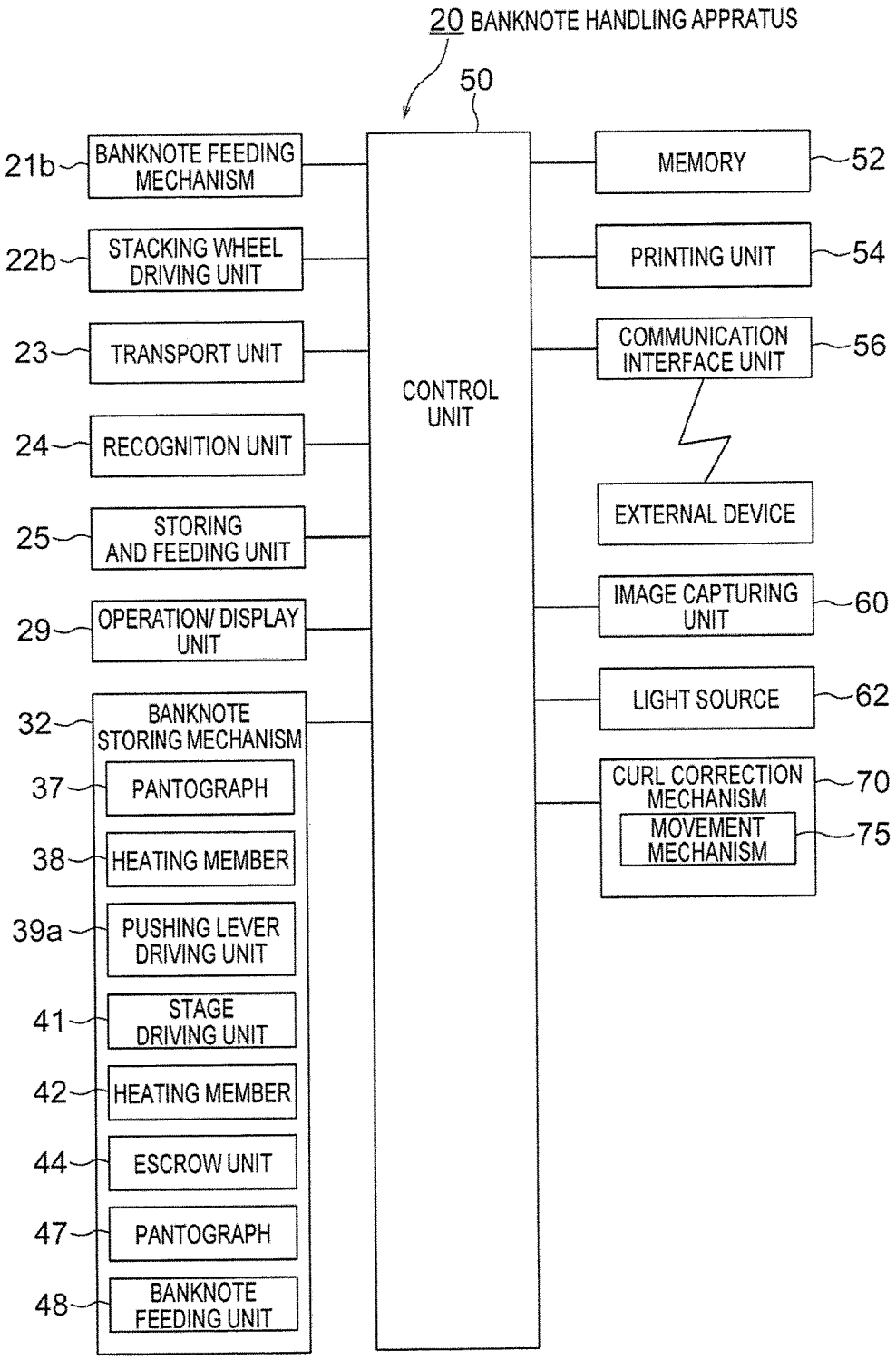

The banknote handling apparatus 20 according to the present embodiment includes the control unit 50 that controls various structural components of the banknote handling apparatus 20. More particularly, as shown in FIG. 8, to the control unit 50 are connected the banknote feeding mechanism 21*b* provided in the banknote receiving unit 21*a* mounted in the inserting unit 21, a stacking wheel driving unit 22*b* that drives a stacking wheel 22*a* provided in the ejecting unit 22, the transport unit 23, the recognition unit 24, the storing and feeding unit 25, the operation/display unit 29, the banknote storing mechanism 32 (specifically, the pantograph 37, the heating members 38, the pushing lever driving unit 39*a*, the stage driving unit 41, the heating members 42, the escrow units 44, the pantograph 47, and the banknote feeding unit 48), the memory 52, a printing unit 54, a communication interface unit 56, the image capturing unit 60, the light source 62, the curl correction mechanism 70 (specifically, the movement mechanism 75), and the like. A signal relating to a recognition result and a detection result of the banknote obtained in the recognition unit 24 and an image captured by the image capturing unit 60 are sent to the control unit 50, the control unit 50 controls the operation of each of the above-mentioned components of the banknote handling apparatus 20 by sending a command signal to those components.

Information about the recognition result and the detection result of the banknote obtained in the recognition unit 24 is stored in the memory 52. A handling history of the money deposition process and the like of the banknotes in the banknote handling apparatus 20, and the information about the inventory amounts and the like of the banknotes stored in each of the banknote collection bags 34 are stored in the memory 52. Moreover, identification information (ID) of each of the banknote collection bags 34 and identification information of the banknotes stored in each of the banknote collection bags 34 are stored in the memory 52 in an associated manner. Moreover, information about a diameter of the drum 25*a* of each of the storing and feeding units 25 and information about a thickness of the winding member 25*b* and information about a set value of the winding strength of the winding member 25*b* are stored in the memory 52. Moreover, for all the banknotes stored in each of the storing and feeding units 25, the order of storing and the date and the time of storing each of the banknotes in each of the storing and feeding units 25 are stored in the memory 52 in an associated manner.

The printing unit 54 prints on a receipt and the like the handling history of the money deposition process and the like of the banknotes in the banknote handling apparatus 20, and the information about the inventory amounts and the like of the banknotes stored in each of the banknote collection bags 34. The control unit 50 can transmit to and receive from an external device (specifically, for example, a host terminal) arranged separately from the banknote handling apparatus 20 according to the present embodiment a signal via the communication interface unit 56. Specifically, the control unit 50 can transmit to the external device arranged separately from the banknote handling apparatus 20 the information stored in the memory 52 via the communication interface unit 56. For example, when a guard of a secure transportation company and the like collects the banknotes together with the banknote collection bag 34, information about the collected banknotes is transmitted to a computer of the secure transportation company and the like via the communication interface unit 56.

An operation in each of the money deposition process, the money dispensing process, and a collection process performed in the banknote handling apparatus 20 according to the present embodiment are explained in detail below. The money deposition process is a process in which, after having recognized by the recognition unit 24 a denomination and the like of the banknotes inserted in the housing 20*a* from the inserting unit 21 of the banknote handling apparatus 20, the banknote is stored, for example, in one of the storing and feeding units 25 according to the denomination of the banknote. The money dispensing process is a process in which the banknote fed from the storing and feeding unit 25 is ejected in the ejecting unit 22 that is accessible from the outside of the housing 20*a*. The collection process is a process in which the banknote inserted in the housing 20*a* from the inserting unit 21 or the banknote fed from the storing and feeding unit 25 is sent to the banknote collection bag 34.

A role in the collection process of the curl correction mechanism 70 that corrects the curl of the banknote in the banknote handling apparatus 20 according to the present embodiment is explained below. As explained below, the curl correction mechanism 70 corrects the curl of the banknote based on the strength of the curl habit of the banknote that passes through the curl correction mechanism 70. As a pre-stage for this purpose, at first, a factor that determines the strength of the curl habit of the banknote fed to the transport unit 23 from each of the storing and feeding units 25 will be explained. The factor that determines the strength of the curl habit of the banknote fed to the transport unit 23 from each of the storing and feeding units 25, for example, can arise from a storing state of the banknote, or can arise from material, dimension, and the like of the features of the banknote.

The factors that determine the strength of the curl habit of the banknote fed to the transport unit 23 from each of the storing and feeding units 25 and arise from the storing state of the banknote are explained below. As explained above, the banknotes are stored in each of the storing and feeding units 25 by winding the banknotes one by one with the winding member 25*b* on the outer peripheral surface of the substantially cylindrical drum 25*a*. Therefore, a distance to the banknote, which has been wound on the drum 25*a* by the winding member 25*b*, from a center of the drum 25*a* (specifically, the rotation axis 25*c*) when seen from a side of the drum 25*a* (that is, when seen from the direction that is orthogonal to the paper surface of FIG. 2) is different depending on the order (more particularly, in which winding turn of the winding member 25*b* on the drum 25*a* the banknote was wound) in which the banknote was wound on the drum 25*a* and stored. Specifically, the distance from the rotation axis 25*c* of the drum 25*a* to the stored banknote is longer for the banknote that was wound in the 10th winding turn of the winding member 25*b* on the drum 25*a* and stored than the banknote that was wound in the 1st winding turn of the winding member 25*b* on the drum 25*a* and stored, for example. In other words, a curvature of the banknote wound by the winding member 25*b* on the drum 25*a* increases as the distance from the rotation axis 25*c* of the drum 25*a* when seen from the side of the drum 25*a* to the banknote wound by the winding member 25*b* on the drum 25*a* reduces. Therefore, the banknote wound by the winding member 25*b* on the drum 25*a* gets a stronger curl habit.

In this manner, the strength of the curl habit of the banknote wound on the drum 25*a* by the winding member 25*b* changes based on the distance from the rotation axis 25*c* of the drum 25*a* when seen from the side of the drum 25*a* to the banknote wound by the winding member 25*b* on the drum 25*a*. Therefore, if the drums 25*a* having different diameters are used in different storing and feeding units 25, the strength of the curl habit of the banknote fed to the transport unit 23 from each of the storing and feeding units 25 will be different depending on the diameter of the drum 25*a* of each of the storing and feeding units 25. That is, if the drum 25*a* having a relatively small diameter is used, because the average value of the distance between the rotation axis 25*c* of the drum 25*a* and the banknote wound by the winding member 25*b* on the drum 25*a* is small, the curvature of the banknote wound by the winding member 25*b* on the drum 25*a* will be relatively large. Therefore, the banknote will be stored in a state in which it will have a strong curl. Therefore, the banknote wound by the winding member 25*b* on the drum 25*a* having the relatively small diameter will have a strong curl habit on the average. On the other hand, if the drum 25*a* having a relatively large diameter is used, because the average value of the distance between the rotation axis 25*c* of the drum 25*a* and the banknote wound by the winding member 25*b* on the drum 25*a* is large, the curvature of the banknote wound by the winding member 25*b* on the drum 25*a* will be relatively small. Therefore, the banknote will be stored in a state in which it will have a relatively weak curl. Therefore, the banknote wound by the winding member 25*b* on the drum 25*a* having the relatively large diameter will have a weak curl habit on the average.

Moreover, even if the configuration of each of the storing and feeding units 25 (specifically, the diameter of the drums 25*a* and the like), the features of the banknote detected by the recognition unit 24 from the banknote fed to the transport unit 23 from each of the storing and feeding units 25 (specifically, dimensions, material, printing states, and the like of the banknotes), and the conditions in which the banknote fed to the transport unit 23 from each of the storing and feeding units 25 was stored in the storing and feeding unit 25 (specifically, the distance from the rotation axis 25*c* of the drum 25*a*, time for which the banknote was stored, and the like) are almost the same, if the winding strengths of the winding members 25*b* are different, the stronger the winding strength of the winding member 25*b*, the stronger the curl habit of the banknote fed to the transport unit 23 from each of the storing and feeding units 25.

Moreover, even if the configuration and setting of each of the storing and feeding units 25 (specifically, the diameter of the drums 25*a*, a set value of the winding strength of the winding members 25*b*, and the like) are almost the same, and the information that is detected by the recognition unit 24 from the banknote fed to the transport unit 23 from each of the storing and feeding units 25 is also almost the same, the banknote stored for a relatively long time in the storing and feeding unit 25 will have a strong curl habit compared with the banknote stored for a relatively short time in the storing and feeding unit 25.

The factors that determine the strength of the curl habit of the banknote fed to the transport unit 23 from each of the storing and feeding units 25 and arise from the material, dimensions, and the like of the features of the banknote are explained below. More particularly, the material of the banknote may include polymer or the material of the banknote may be polymer itself. The banknote made from the polymer and the banknote including the polymer is hard to get the curl habit compared with the banknote made only from paper. However, if the banknote gets the curl habit because it was stored in the curled state and the like, a stronger external force is necessary to correct the curl habit of such a banknote compared with the banknote made of only paper. That is, the banknote made from the polymer and the banknote including the polymer will have a strong curl habit compared with the banknote made of only paper. Because the banknote made from the polymer and the banknote including the polymer have such a property, the curl habit of the banknote made from the polymer and the banknote including the polymer stored in each of the storing and feeding units 25 for a relatively short time will be weaker compared with the banknote made only from paper. On the other hand, the curl habit of the banknote made from the polymer and the banknote including the polymer stored in each of the storing and feeding units 25 for a relatively long time will be stronger compared with the banknote made only from paper. Moreover, a metal wire may be embedded in the banknote to prevent a fraudulent activity (for example, forgery of the banknote and the like). The curl habit of such a banknote will be stronger compared with the banknote made only from paper. Moreover, regardless of the material and the like of the banknote, the strength of the curl habit of the banknote varies depending on material and quantity of the ink used for printing the banknote (for example, the greater the quantity of ink used for printing, the stronger the curl habit of the banknote).

In the banknote handling apparatus 20 according to the present embodiment, a degree of the correction of the curl applied by the curl correction mechanism 70 is adjusted based on a long edge length of the banknote (that is, the length of the banknote in the transport direction of the banknote) stored in each of the storing and feeding units 25. As explained above, the banknotes are stored in each of the storing and feeding units 25 such that the long side (that is, the transport direction) of the banknote substantially coincides with the circumferential direction of the drum 25*a*. Therefore, the banknote having a long long edge length is stored in a strongly curled state in each of the storing and feeding units 25 compared with the banknote having a short long edge length. Thus, the banknote having the long long edge length gets a strong curl habit.

Note that, the transport unit 23 may be adapted to transport the banknote along the short side of the banknote. In this case, the banknotes are stored in each of the storing and feeding units 25 such that the short side of the banknote substantially coincides with the circumferential direction of the drum 25*a*. Also, the banknote stored in each of the storing and feeding units 25 will have the curl habit along the short side of the banknote. Moreover, the banknote having a long short edge length is stored in a strongly curled state in each of the storing and feeding units 25 compared with the banknote having a short short edge length. Thus, the banknote having the long short edge length gets a strong curl habit.

A role in the collection process of the curl correction mechanism 70 in the banknote handling apparatus 20 according to the present embodiment is explained below. More particularly, as explained above, the collection process of the banknote is a process in which the banknotes inserted from the inserting unit 21 to the inside of the housing 20*a* of the banknote handling apparatus 20 or the banknotes fed to the transport unit 23 from each of the storing and feeding units 25 are stored in a stacked manner in the banknote collection bag 34 by the banknote storing mechanism 32. Three types of banknotes can be considered as the banknotes that should be collected in the collection process in the banknote handling apparatus 20. The first type of banknotes is the banknotes fed to the transport unit 23 from each of the storing and feeding units 25. The second type of banknotes is the banknotes manually inserted by the operator from the banknote receiving unit 21*a*. The third type of banknotes is the banknotes fed to the transport unit 23 from the banknote storing cassette 21*c*.

As explained above, the banknote fed to the transport unit 23 from each of the storing and feeding units 25 gets a curl habit of a different strength depending on the storing state, dimension, material and the like of the features of the banknote, the diameter of the drum 25*a*, the winding strength of the winding member 25*b*, and the like. In the banknote handling apparatus 20 according to the present embodiment, information and the like about the banknote fed to the transport unit 23 from each of the storing and feeding units 25 is stored in the memory 52. Moreover, the control unit 50 controls the transport speed of the banknote in the curl correction mechanism 70 and the transport unit 23 based on the information stored in the memory 52. Accordingly, after correcting the curl of the banknote, fed to the transport unit 23 from each of the storing and feeding units 25, at an appropriate strength by the curl correction mechanism 70, the banknote can be sent to the banknote storing mechanism 32.

More particularly, when correcting the curl of the banknote that has a relatively weak curl habit (for example, the banknote that was stored at a position whose distance from the rotation axis 25*c* of the drum 25*a* is longer than a predetermined threshold) by using the curl correction mechanism 70, the curl of the banknote is corrected by setting the transport speed of the banknote in the transport unit 23 to a first predetermined speed that is lower than the transport speed of the banknote in the money deposition process and the like, and positioning the upper rollers 74 of the curl correction mechanism 70 at the operating position. Accordingly, it is possible to suitably correct the curl of the banknote according to processing contents. Therefore, any disadvantage (for example, a stacking failure occurs in the stacking unit when a too strong habit is applied to the banknote by the lower rollers 72 and the upper rollers 74, and the like) that may occur due to excessive correction of the curl of the banknote by the curl correction mechanism 70 can be prevented. If the strength of the curl habit of the banknote fed to the transport unit 23 from each of the storing and feeding units 25 is correctable even without reducing the transport speed of the banknote in the transport unit 23, the curl of the banknote can be corrected by using the curl correction mechanism 70 without reducing the transport speed of the banknote.

On the other hand, when correcting the curl of the banknote that has a relatively strong curl habit (for example, the banknote that was stored at a position whose distance from the rotation axis 25*c* of the drum 25*a* is shorter than the predetermined threshold) by using the curl correction mechanism 70, the curl of the banknote is corrected by, for example, setting the transport speed of the banknote in the transport unit 23 to a second predetermined speed that is lower than the first predetermined speed, and positioning the upper rollers 74 of the curl correction mechanism 70 at the operating position. Accordingly, it is possible to suitably correct the curl habit of the banknote that has a relatively strong curl habit. Therefore, it is possible to suppress the occurrence of a stacking failure of the banknotes stacked in the banknote storing mechanism 32 due to insufficient correction of curl of the banknote by the curl correction mechanism 70.

The banknote handling apparatus 20 according to the present embodiment is not limited to a case in which only one threshold of the distance of the banknote stored in the storing and feeding unit 25 from the rotation axis 25*c* of the drum 25*a* can be set. More than one such thresholds can be set. Specifically, the distance between the rotation axis 25*c* of the drum 25*a* and the banknote stored last (that is, the banknote that is stored at a position most away from the rotation axis 25*c* of the drum 25*a*) when the banknotes are stored up to an upper limit in each of the storing and feeding units 25 is divided into a plurality of sections, and the curl of the banknote stored in a given section among those sections can be corrected by using a predetermined strength specific to the given section. Note that, whether a banknote fed from each of the storing and feeding units 25 was stored at a position whose distance from the rotation axis 25*c* of the drum 25*a* is smaller than the predetermined threshold can be determined based on the information stored in the memory 52.

The collection process of the banknotes manually inserted by the operator in the housing 20*a* from the banknote receiving unit 21*a* is explained below. In this case, generally, such inserted banknotes are directly sent to the banknote storing mechanism 32 without correcting the curl of the banknote by the curl correction mechanism 70. Because, generally, the banknotes manually inserted by the operator in the housing 20*a* do not have a curl habit to an extent that will cause the stacking failure when stacked in the banknote storing mechanism 32. Accordingly, such banknotes can be transported at a higher speed in comparison with a case in which the curl of the banknote is to be corrected by the curl correction mechanism 70. Therefore, the handling efficiency of the banknotes can be improved.

The collection process of the banknotes fed from the banknote storing cassette 21*c* is explained below. The banknotes fed from the banknote storing cassette 21*c* can include banknotes that have the curl habit and the banknotes that do not have the curl habit. Therefore, when performing the collection process of the banknotes fed from the banknote storing cassette 21*c*, whether to correct the curl of the banknotes by using the curl correction mechanism 70 can be selected by using, for example, the operation/display unit 29 and the like. Accordingly, the banknotes that are fed from the banknote storing cassette 21*c* and do not have the curl habit can be transported at a higher speed. Therefore, the handling efficiency of the banknotes can be improved. Note that, it is not limited to perform the selection regarding whether to correct the curl habit of the banknote by the curl correction mechanism 70 only when performing the collection process of the banknotes fed from the banknote storing cassette 21*c*. That is, whether to correct the curl habit of the banknote by the curl correction mechanism 70 can be selected when performing the collection process of the banknote fed from each of the storing and feeding units 25, or when performing the collection process of the banknote manually inserted by the operator. Moreover, in all the collection processes, that is, when performing the collection process of the banknote fed from the banknote storing cassette 21*c*, when performing the collection process of the banknote fed from each of the storing and feeding units 25, and when performing the collection process of the banknote manually inserted by the operator, it is allowable to configure so that whether to correct the curl of the banknotes by the curl correction mechanism 70 can be set at a time by using the operation/display unit 29 and the like.

Thus, in the banknote handling apparatus 20 according to the present embodiment, the curl of the banknotes fed to the transport unit 23 from each of the storing and feeding units 25 can be corrected by the curl correction mechanism 70 based on the storing state of the banknotes in each of the storing and feeding units 25 and the information and the like of the features and the like of the banknotes detected by the recognition unit 24.

Figure 9:
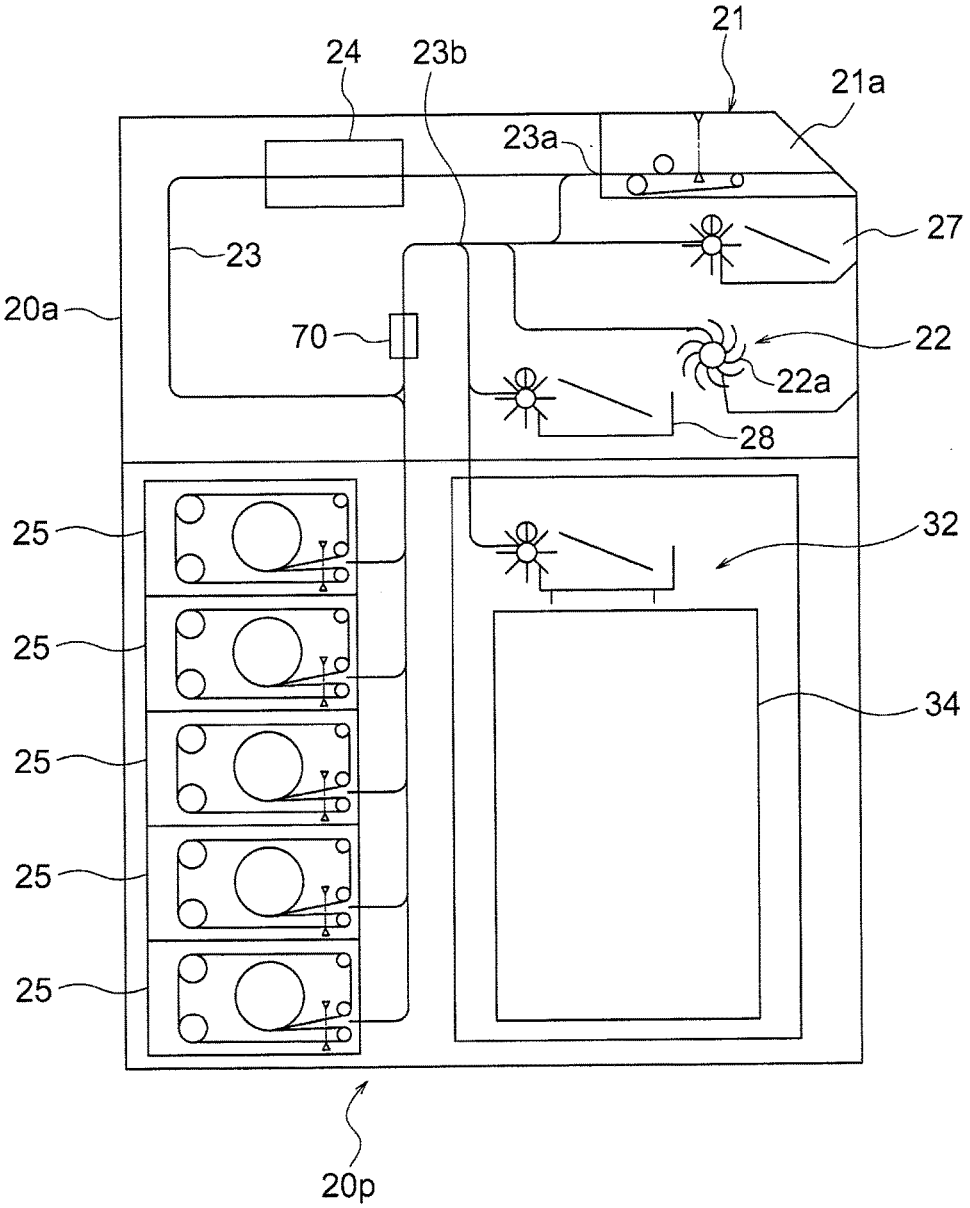
FIG. 9 is a side view of another example of an internal configuration of the banknote handling apparatus according to the present embodiment.
Figure 10:
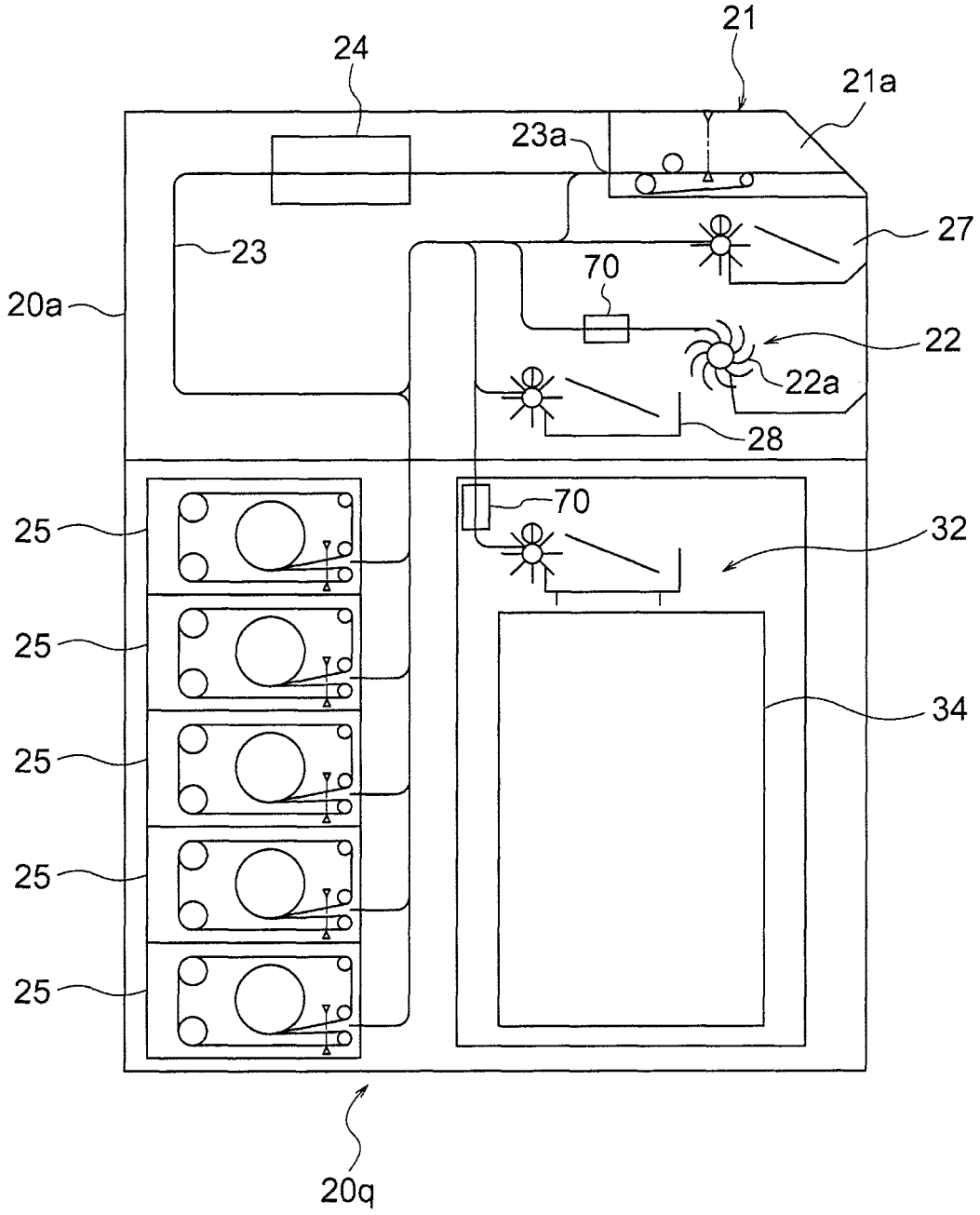
FIG. 10 is a side view of still another example of an internal configuration of the banknote handling apparatus according to the present embodiment.

As other example of the banknote handling apparatus according to the present embodiment, instead of arranging the curl correction mechanism 70 near (see FIG. 2) the banknote storing mechanism 32, the curl correction mechanism 70 can be arranged at a position shown in FIG. 9. In a banknote handling apparatus 20*p* according to the example shown in FIG. 9, the curl correction mechanism 70 is arranged upstream of a diversion point 23*b* of the ejecting unit 22 and the banknote storing mechanism 32 in the transport unit 23. As still another example of the banknote handling apparatus according to the present embodiment is shown in FIG. 10. In a banknote handling apparatus 20*q* shown in FIG. 10, the curl correction mechanism 70 is arranged near the banknote storing mechanism 32, and one more curl correction mechanism 70 is arranged near the ejecting unit 22. Even in the banknote handling apparatuses 20*p* and 20*q* of the examples shown in FIGS. 9 and 10, an advantage similar to that explained above in connection to the banknote handling apparatus 20 can be achieved when performing the collection process of the banknotes.

In the banknote handling apparatuses 20*p* and 20*q* of the examples shown in FIGS. 9 and 10, when performing the money dispensing process, the banknotes can be stacked in the ejecting unit 22 after correcting the curl of the banknotes fed to the transport unit 23 from each of the storing and feeding units 25 by using the curl correction mechanism 70. Note that, because the number (for example, several dozens) of banknotes ejected at one time in the money dispensing process is less compared with the number (for example, several hundred) of banknotes sent to the banknote storing mechanism 32 in the collection process, a stacking failure is less likely to occur even if the banknotes ejected in the ejecting unit 22 have a curl habit. Therefore, the degree of the correction of the curl of the banknote by the curl correction mechanism 70 is adjusted by the control unit 50 according to the processing contents of the banknote so that the degree of the correction is stronger during the collection process than during the money dispensing process.

In the banknote handling apparatuses 20, 20*p*, and 20*q* according to the present embodiment, the degree of the correction of the curl of the banknotes by the curl correction mechanism 70 is set higher when transporting by the transport unit 23 the banknotes fed from each of the storing and feeding units 25 than when transporting by the transport unit 23 the banknotes inserted in the housing 20*a* from the inserting unit 21. Accordingly, the banknotes can be transported through the curl correction mechanism 70 at a high speed compared with a case in which the curl of all the banknotes is corrected by substantially the same degree by using the curl correction mechanism 70. Therefore, the handling efficiency of the banknotes can be improved.

Figure 11:
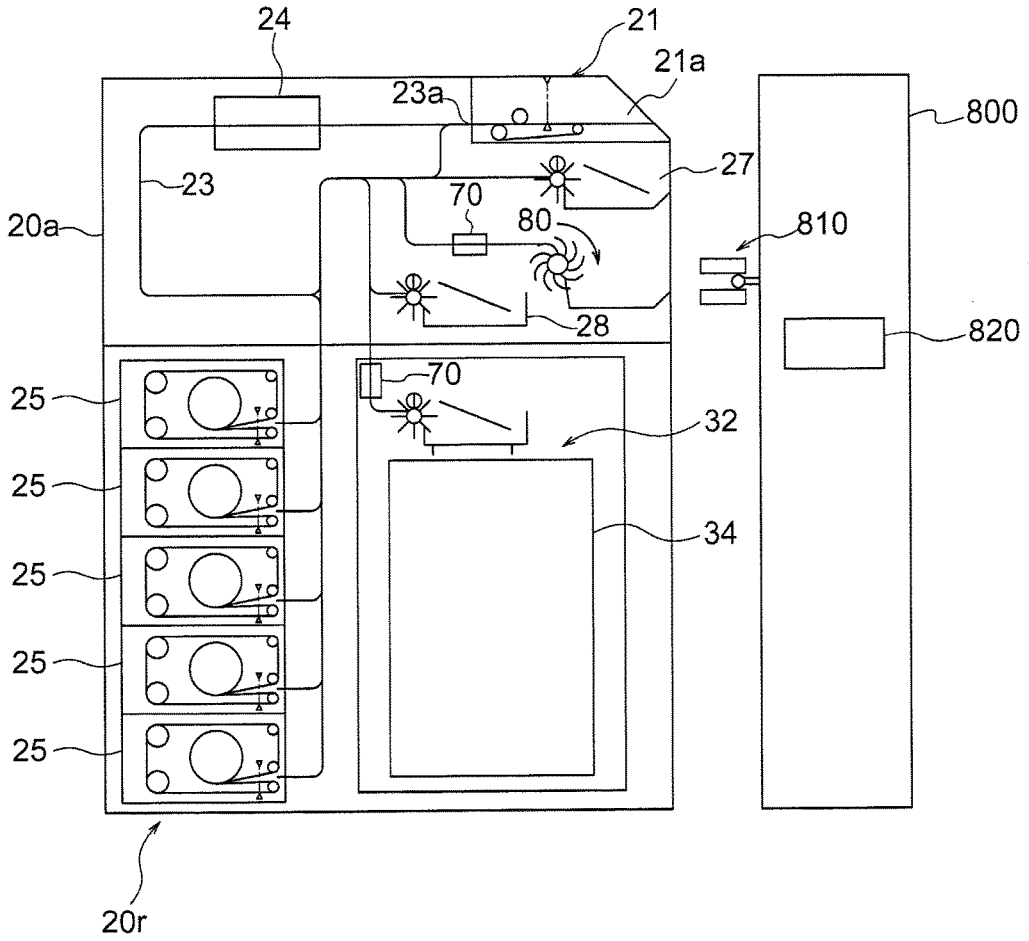
FIG. 11 is a side view of still another example of an internal configuration of the banknote handling apparatus according to the present embodiment.

A still another example of the banknote handling apparatus according to the present embodiment is shown in FIG. 11. In a banknote handling apparatus 20*r* shown in FIG. 11, the ejecting unit 22 is replaced with an escrow unit for bundling 80 that functions as a stacking unit for temporarily stacking the banknotes that should be bundled by using a bundling medium. Moreover, in the banknote handling apparatus 20*r* according to the example shown in FIG. 11, one curl correction mechanism 70 is arranged in the transport unit 23 at a position near the banknote storing mechanism 32 and another curl correction mechanism 70 is arranged near the escrow unit for bundling 80. Accordingly, the banknotes after the curl of the banknote has been corrected by the curl correction mechanism 70 can be stacked in the escrow unit for bundling 80 in which the banknotes that should be bundled by using the bundling medium are temporarily stacked. Moreover, the banknote handling apparatus 20*r* according to the example shown in FIG. 11 can be used along with a bundling device 800 that bundles the banknotes temporarily stacked in the escrow unit for bundling 80. More particularly, the bundling device 800 includes a transport arm 810 for transporting to the bundling device 800 a bundle of banknotes of a predetermined number (for example, 100 banknotes) stacked in the escrow unit for bundling 80, and a bundling part 820. The banknotes transported by the transport arm 810 are bundled by the bundling part 820 thereby forming a banknote bundle. Accordingly, after correcting the curl habit of the banknote by the curl correction mechanism 70, it is possible to bundle the banknotes of the predetermined number stacked in the escrow unit for bundling 80 by using the bundling device 800.

Note that, the configuration of the banknote handling apparatus according to the present embodiment is not limited to the embodiment mentioned above and can be changed as desired in various manner.

For example, in the banknote handling apparatuses 20, 20*p*, 20*q*, and 20*r* according to the present embodiment, as the curl correction mechanism, instead of the curl correction mechanism 70 including the lower rollers 72, the upper rollers 74, and the like, a curl correction mechanism having different configuration can be used. For example, a curl correction mechanism that uses heat can be used. Specifically, the curl of the banknote can be corrected by making a hot member, such as an iron, touch the banknote transported by the transport unit 23. Alternatively, the curl of the banknote can be corrected by blowing hot wind and the like toward the banknote from a wind blower arranged at a position separated from the transport unit 23.

It is not limited that the lower rollers 72 arranged on the axis 71 and the upper rollers 74 arranged on the axis 73 in the curl correction mechanism 70 are respectively provided in a pair. For example, even if three or more lower rollers and three or more upper rollers are provided, the curl of the banknotes can be corrected by using the curl correction mechanism.

Figure 12:
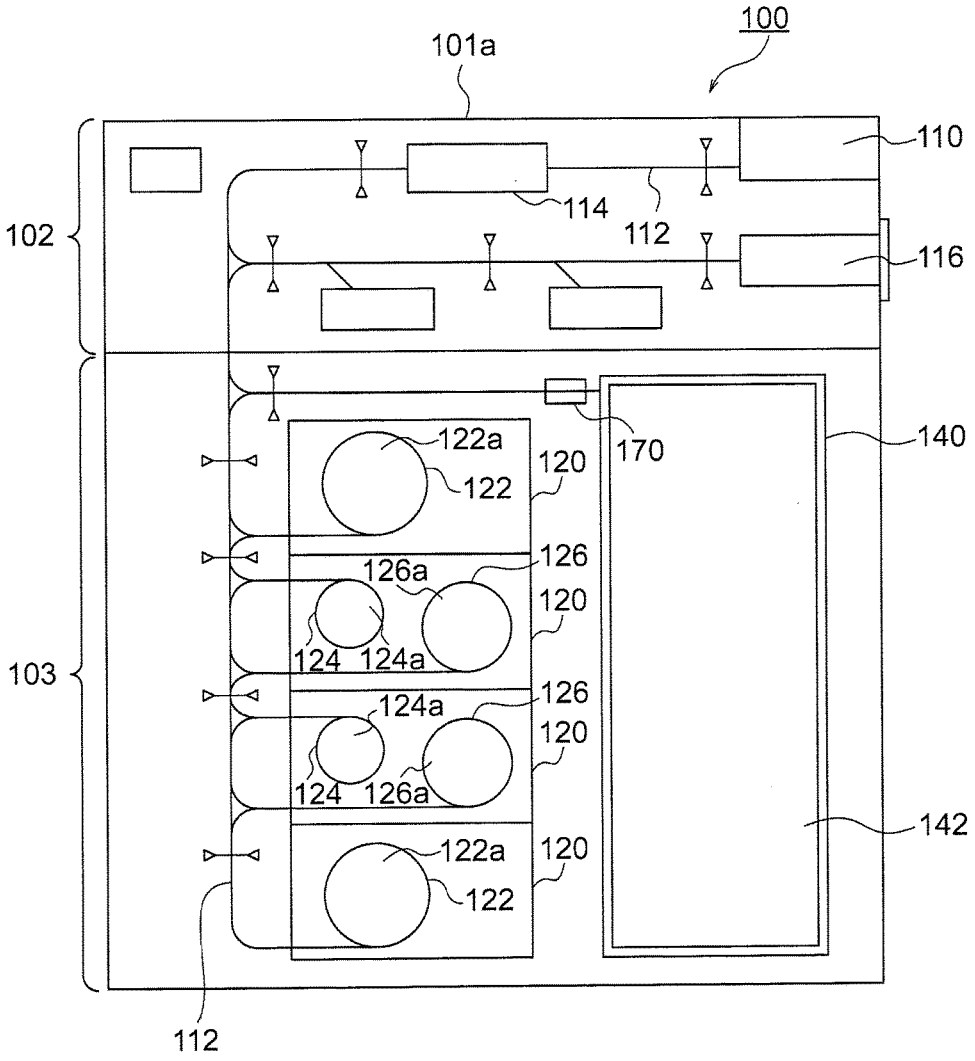
FIG. 12 is a side view of still another example of an internal configuration of the banknote handling apparatus according to the present embodiment.

A still another example of the banknote handling apparatus according to the present embodiment is shown in FIG. 12. FIG. 12 is a side view of still another example of an internal configuration of the banknote handling apparatus according to the present embodiment. A banknote handling apparatus 100 according to the example shown in FIG. 12 includes a housing 101*a* of a substantially rectangular parallelepiped shape. Moreover, the banknote handling apparatus 100 according to the example shown in FIG. 12 includes an upper unit 102 and a lower unit 103. The upper unit 102 includes a banknote inserting unit 110 for inserting a banknote to the inside of the housing 101*a* from the outside thereof, a transport unit 112 that transports the banknote inserted by the banknote inserting unit 110 to the inside of the housing 101*a*, a recognition unit 114 arranged in the transport unit 112 and that recognizes the banknote transported by the transport unit 112, and a banknote ejecting unit 116 for ejecting the banknote to the outside of the housing 101*a* from the inside thereof. The recognition unit 114 recognizes a denomination, an authenticity, a fitness, a version, a face side up/back side up, a transportation state and the like of the banknote transported by the transport unit 112. The banknote recognized by the recognition unit 114 is sent, for example, to one of later-explained storing and feeding units 120 by the transport unit 112 according to the denomination of the banknote.

As seen from FIG. 12, the transport unit 112 extends in both the upper unit 102 and the lower unit 103. A plurality of (four in the example shown in FIG. 12) storing and feeding units 120 is connected to the transport unit 112 in the lower unit 103. Each of the storing and feeding units 120 can store therein the banknotes sent by the transport unit 112. Moreover, each of the storing and feeding units 120 can feed the stored banknotes one by one to the transport unit 112. More particularly, among the four storing and feeding units 120, each of the uppermost storing and feeding unit 120 and the bottommost storing and feeding unit 120 includes a banknote storing mechanism 122 having one drum 122*a*. A pair of winding members between which the banknotes sent by the transport unit 112 are sandwiched one by one is wound on the drum 122*a* along with the banknotes. When the drum 122*a* is rotated in an opposite direction of a winding direction of the winding members, the banknotes sandwiched between the winding members can be fed one by one to the transport unit 112 as the winding members are unwound from the drum 122*a*. Among the four storing and feeding units 120, each of the second storing and feeding unit 120 from the top and the third storing and feeding unit 120 from the top includes two banknote storing mechanism 124 and 126 having mutually different maximum storing capacities of the banknotes. The banknote storing mechanism 124 and 126 respectively includes drums 124*a* and 126*a*. More particularly, in the banknote storing mechanism 124 and 126, a pair of winding members between which the banknotes sent by the transport unit 112 are sandwiched one by one is wound on the drums 124*a* and 126*a* along with the banknotes. When the drum 124*a* or 126*a* is rotated in an opposite direction of a winding direction of the winding members, the banknotes sandwiched between the winding members can be fed one by one to the transport unit 112 as the winding members are unwound from the drum 124*a* or 126*a*.

A cassette mounting unit 140 is arranged in the lower unit 103, and the cassette mounting unit 140 is connected to the transport unit 112. This cassette mounting unit 140 is used to collect the banknotes stored in the storing and feeding units 120. More specifically, a banknote collecting cassette 142 for storing the banknotes in a stacked manner is detachably attached in the cassette mounting unit 140. The banknote sent from each of the storing and feeding units 120 to the cassette mounting unit 140 via the transport unit 112 is stored in the banknote collecting cassette 142.

In the transport unit 112 near the cassette mounting unit 140 is arranged a curl correction mechanism 170. The curl correction mechanism 170 has substantially the same configuration as the curl correction mechanism 70. More particularly, in the banknote handling apparatus according to the example shown in FIG. 12, like the curl correction mechanism 70, the curl correction mechanism 170 includes a pair of lower rollers arranged rotatably on a position-fixed axis and having a groove, and a pair of upper rollers arranged rotatably on a movable axis that extends parallel to the position-fixed axis. The curl habit of the banknote is corrected by the banknote being sandwiched between the upper rollers and the lower rollers. Accordingly, the banknote is sent to the cassette mounting unit 140 after the curl habit of the banknote having the curl habit fed from each of the storing and feeding units 120 is corrected. Therefore, it is possible to suppress the occurrence of a stacking failure of the banknotes stacked in the banknote collecting cassette 142 mounted in the cassette mounting unit 140.

When the drums 122*a* and 126*a* rotate counterclockwise when seen from a direction that is orthogonal to the paper surface of FIG. 12, the banknotes are stored as the winding members with the banknotes are wound on the drums 122*a* and 126*a*. On the other hand, when the drums 124*a* rotate clockwise when seen from the direction that is orthogonal to the paper surface of FIG. 12, the banknotes are stored as the winding members with the banknotes are wound on the drums 124*a*. That is, opposite curl habits are applied to the banknotes stored on the drums 122*a* and 126*a* and to the banknotes stored on the drums 124*a*. However, because the curl correction mechanism 170 has the configuration explained above, regardless of the direction of the curl habit of the banknotes fed from each of the storing and feeding units 120, the curl habit of the banknotes can be corrected by using the curl correction mechanism 170.

In the banknote handling apparatus 100 according to the example shown in FIG. 12, occurrence of a stacking failure of the banknotes in the banknote collecting cassette 142 can be suppressed even without providing the curl correction mechanism 170. This is explained below in detail with a specific example.

For example, in a state in which at least one banknote is stored in any of the banknote storing mechanism 122, 124, 126 of the storing and feeding units 120, first, the banknote that is stored by the winding members being wound on a certain drum (for example, the drum 122*a* of the first storing and feeding unit 120 from the top) is sent to the cassette mounting unit 140, and the banknote is stacked in the banknote collecting cassette 142. This banknote fed from the first storing and feeding unit 120 from the top has the curl habit; however, because all the banknotes fed from the first storing and feeding unit 120 from the top will have the curl habit in the same direction, a stacking failure is less likely to occur in the banknote collecting cassette 142.

Subsequently, the banknote that is stored by the winding members being wound on another drum (for example, the drum 122*a* of the fourth storing and feeding unit 120 from the top) and that has a curl habit in a certain direction is fed to the transport unit 112. The banknote fed to the transport unit 112 is stored on the drum 122*a* of the first storing and feeding unit 120 from the top by winding the winding members along with the banknote on this drum. Accordingly, the banknote that had the curl habit in the certain direction can be stored in the first storing and feeding unit 120 from the top in a state in which the banknote has a curl in an opposite direction of the curl habit. More specifically, when seen from the direction that is orthogonal to the paper surface of FIG. 12, the direction of the curl habit of the banknote stored in the first storing and feeding unit 120 from the top and the direction of the curl habit of the banknote stored in the fourth storing and feeding unit 120 from the top are the same. However, when the banknote fed from the fourth storing and feeding unit 120 from the top is stored in the first storing and feeding unit 120 from the top, the face side up/back side up of the banknote is switched. Therefore, the banknote that was fed from the fourth storing and feeding unit 120 from the top will be stored in the first storing and feeding unit 120 from the top in a state in which the banknote will have a curl in an opposite direction of the curl habit that the banknote originally had. Therefore, the curl habit of the banknote fed from the fourth storing and feeding unit 120 from the top can be corrected. Accordingly, the banknote can be sent to the cassette mounting unit 140 after the curl habit of the banknote fed from each of the storing and feeding units 120 is corrected. Therefore, it is possible to suppress the occurrence of a stacking failure of the banknotes stacked in the banknote collecting cassette 142 mounted in the cassette mounting unit 140.

The banknote stored in the banknote storing mechanism 126 of the second storing and feeding unit 120 from the top and the banknote stored in the banknote storing mechanism 126 of the third storing and feeding unit 120 from the top are sent to the banknote storing mechanism 122 of the first storing and feeding unit 120 from the top. Thus, the banknote is sent to the cassette mounting unit 140 after the curl habit of the banknote stored in each of the banknote storing mechanism 126 is corrected.

On the other hand, to correct the curl habit of the banknote stored in the banknote storing mechanism 124 of the second storing and feeding unit 120 from the top and the curl habit of the banknote stored in the banknote storing mechanism 124 of the third storing and feeding unit 120 from the top, the banknote stored in each of the banknote storing mechanism 124 is sent to the banknote storing mechanism 126 once, and then the banknote is sent from the banknote storing mechanism 126 to the banknote storing mechanism 122. Thus, the curl habit of the banknote stored in the banknote storing mechanism 124 can be corrected by using the banknote storing mechanism 122. Thereafter, the curl habit corrected banknote is sent to the cassette mounting unit 140 from the banknote storing mechanism 122. Thus, even if the banknote handling apparatus according to the example shown in FIG. 12 does not include the curl correction mechanism 170, the banknote can be sent to the cassette mounting unit 140 after correcting the curl habit of the banknote stored in any of the second to the fourth storing and feeding units 120 from the top.

Note that, it may not be always necessary to correct the curl habit of the banknote with the above method of using the banknote storing mechanism 122 of the first storing and feeding unit 120 from the top. For example, when starting the collection process of the banknote, among the banknote storing mechanism 122, 124, 126, all the banknote stored in the banknote storing mechanism with the least number of banknotes is sent to the cassette mounting unit 140. Then, the banknote stored in the other banknote storing mechanism 122, 124, 126 is sent to the banknote storing mechanism that has become empty thereby correcting the curl habit of the banknote stored the other banknote storing mechanism 122, 124, 126. Moreover, when starting the collection process of the banknote, if an empty banknote storing mechanism is available among the banknote storing mechanism 122, 124, 126, the curl habit of the banknote stored the other banknote storing mechanism 122, 124, 126 can be corrected by using this empty banknote storing mechanism. Note that, when using the banknote handling apparatus 100 in this manner, because it is possible to reduce the number of banknotes having the curl habit to be sent to the cassette mounting unit 140 as much as possible, it is possible to suppress that a stacking failure of the banknote occurs in the banknote collecting cassette 142 mounted in the cassette mounting unit 140.

As another mode of use of the banknote handling apparatus 100 according to the example shown in FIG. 12, for example, one banknote storing mechanism among the banknote storing mechanism 122, 124, 126 can be used for reconciliation of the banknote, and the banknote is not stored in this banknote storing mechanism other than when performing the reconciliation process of the banknote. In this case, the banknote can be sent to the cassette mounting unit 140 after the curl habit of all banknotes stored in each of the storing and feeding units 120 is corrected by using the banknote storing mechanism for reconciliation.

In the banknote handling apparatus according to the example shown in FIG. 12, assume that the curl correction mechanism 170 is omitted, and the banknote fed from each of the storing and feeding units 120 is to be directly sent to the cassette mounting unit 140. Even in this case, the occurrence of a stacking failure in the banknote collecting cassette 142 mounted in the cassette mounting unit 140 can be suppressed by using the following method. More particularly, first, among the banknote stored in each of the storing and feeding units 120, all the banknotes (for example, the banknote stored in each of the banknote storing mechanism 122 and 126) that have the curl habit in a certain direction are sent to the cassette mounting unit 140. Thereafter, among the banknote stored in each of the storing and feeding units 120, all the banknotes (for example, the banknote stored in each of the banknote storing mechanism 124) that have the curl habit in an opposite direction of the certain direction are sent to the cassette mounting unit 140. That is, first the banknotes having the curl habit in the certain direction are gathered and stacked in the banknote collecting cassette 142, and then the banknotes that have the curl habit in the opposite direction of the certain direction are gathered and stacked in the banknote collecting cassette 142. By doing so, in comparison to a case in which the collection process is performed without gathering the banknotes having the curl habit in the same direction, the occurrence of a stacking failure in the banknote collecting cassette 142 can be suppressed.

Figure 13:
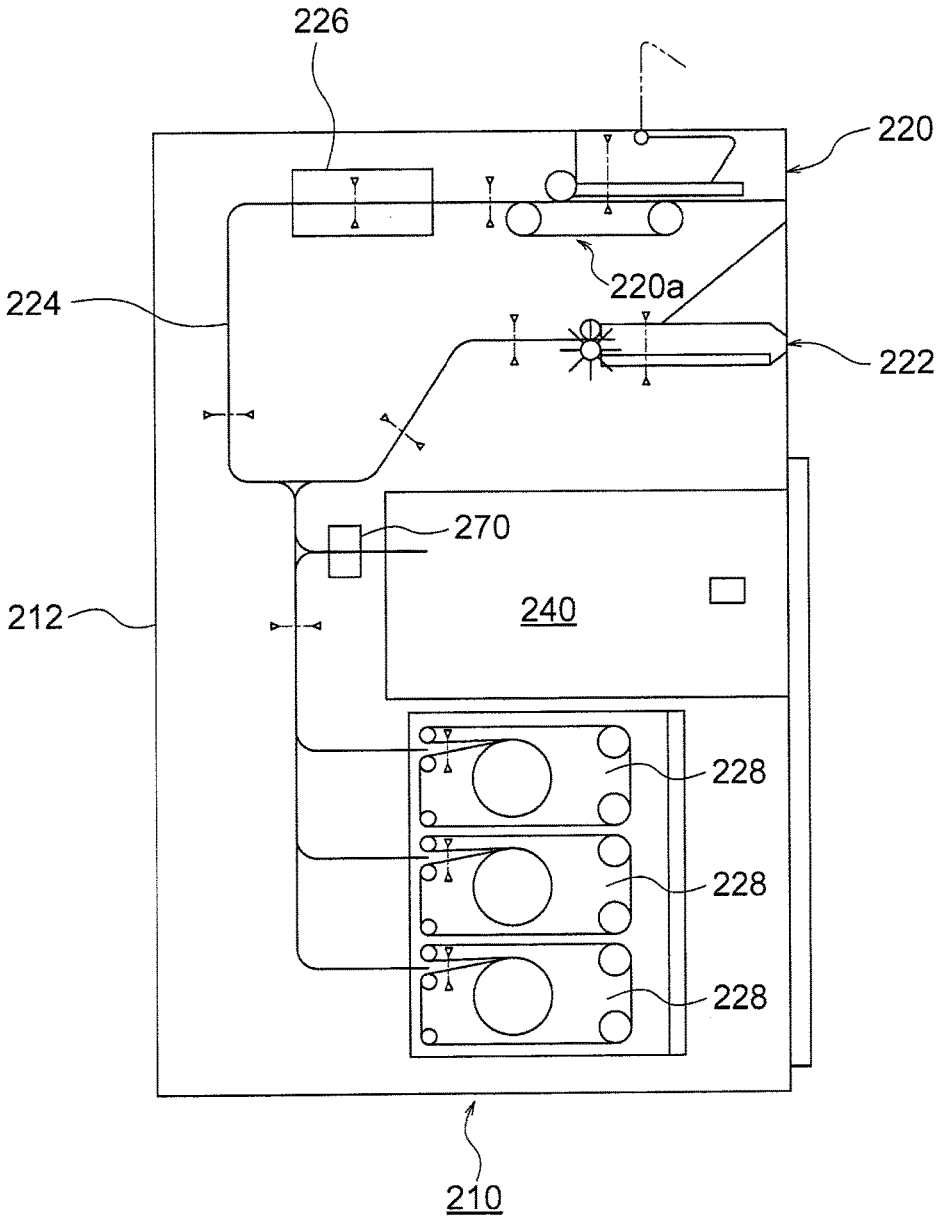
FIG. 13 is a side view of still another example of an internal configuration of the banknote handling apparatus according to the present embodiment.

A still another example of the banknote handling apparatus according to the present embodiment is shown in FIG. 13. FIG. 13 is a side view of still another example of an internal configuration of the banknote handling apparatus according to the present embodiment. A banknote handling apparatus 210 according to the example shown in FIG. 13 includes a housing 212, an inserting unit 220 for inserting a banknote in the housing 212, and an ejecting unit 222 for ejecting the banknote to the outside of the housing 212. The inserting unit 220 has an insertion opening for inserting loose banknotes inside the housing 212 from the outside thereof. The ejecting unit 222 has an ejection opening for ejecting the loose banknotes to the outside of the housing 212 from the inside thereof. The inserting unit 220 is provided with a feeding mechanism **220*a* for feeding to a later-explained transport unit 224 the banknotes one by one inserted from the inserting unit 220. As shown in FIG. 13, in the banknote handling apparatus 210, the transport unit 224 is arranged in the housing 212. The banknotes inserted in the housing 212 from the inserting unit 220 are transported one by one in the housing 212 by the transport unit 224. Moreover, a recognition unit 226 is arranged in the transport unit 224. The recognition unit 226 recognizes a denomination, an authenticity, a fitness, a version, and the like of the banknote transported by the transport unit 224**.

A plurality of storing and feeding units 228 is arranged in the housing 212. Each of the storing and feeding units 228 is connected to the transport unit 224. Each of the storing and feeding units 228 stores therein the banknote, inserted in the housing 212 from the inserting unit 220 and that is recognized by the recognition unit 226, according to a denomination of the banknote. More particularly, the banknote is sent by the transport unit 224 to one of the storing and feeding units 228 according to the denomination of the banknote based on a recognition result obtained in the recognition unit 226. Each of the storing and feeding units 228 can feed the banknotes stored therein one by one to the transport unit 224. Each of the storing and feeding units 228 is a storing and feeding unit that winds banknotes by using a pair of belt-shaped winding members in a state in which the banknotes are sandwiched one by one between the winding members.

As seen in FIG. 13, a cassette mounting unit 240 is arranged in the housing 212. A banknote collecting cassette 244 shown in FIG. 14 is detachably accommodated in the cassette mounting unit 240. As shown in FIG. 14, the banknote collecting cassette 244 is provided with a stacking unit 244*a* in which a plurality of banknotes (marked with the reference letter P in FIG. 14) can be stacked. Therefore, when the banknote collecting cassette 244 has been mounted in the cassette mounting unit 240, the banknotes sent to the banknote collecting cassette 244 from the transport unit 224 of the banknote handling apparatus 210 are stacked in the stacking unit 244*a*. A not-shown banknote feeding mechanism is arranged in the banknote collecting cassette 244. The banknotes stacked in the stacking unit 224*a* of the banknote collecting cassette 244 can be fed to the transport unit 224 one by one by using the banknote feeding mechanism.

The banknote storing cassette 21*c* can be also mounted in the cassette mounting unit 240. Therefore, exchange of the banknotes is possible between the banknote handling apparatus 20 according to the present embodiment and the banknote handling apparatus 210 shown in FIG. 14 (that is, between two different banknote handling apparatuses) by using the banknote storing cassette 21*c* and the banknote collecting cassette 244. Note that, if the banknote storing cassette 21*c* has substantially the same configuration as the storing and feeding unit 25, the banknotes will be stored in a curled state in the banknote storing cassette 21*c*. Therefore, the banknote fed from the banknote storing cassette 21*c* will have a relatively strong curl habit.

A curl correction mechanism 270 having substantially the same configuration as the curl correction mechanism 70 is arranged near the cassette mounting unit 240 in the transport unit 224. More particularly, in the banknote handling apparatus 210 according to the example shown in FIG. 13, like the curl correction mechanism 70, the curl correction mechanism 270 includes a pair of lower rollers arranged rotatably on a position-fixed axis and having a groove, and a pair of upper rollers arranged rotatably on a movable axis that extends parallel to the position-fixed axis. The curl habit of the banknote is corrected by the banknote being sandwiched between the upper rollers and the lower rollers. Accordingly, after the curl habit of the banknote fed from each of the storing and feeding units 228 is corrected, the banknote can be stacked in the stacking unit 244*a* provided in the banknote collecting cassette 244 mounted in the cassette mounting unit 240. Therefore, it is possible to suppress the occurrence of a stacking failure of the banknotes in the stacking unit 244*a* provided in the banknote collecting cassette 244.

Note that, when feeding the banknote from the banknote storing cassette 21*c* or the banknote collecting cassette 244 mounted in the cassette mounting unit 240, the degree of correction of the curl of the banknote by the curl correction mechanism 270 can be changed depending on the strength of the curl habit of the banknote fed from these cassettes. More particularly, for example, it is more likely that the curl habit of the banknote fed from the banknote storing cassette 21*c* is stronger than the curl habit of the banknote fed from the banknote collecting cassette 244. Therefore, by setting the degree of correction of the curl by the curl correction mechanism 270 of the banknote fed from the banknote storing cassette 21*c* relatively stronger, and setting the degree of correction of the curl of the banknote fed from the banknote collecting cassette 244 relatively weaker, the curl of the banknote can be corrected with an appropriate strength.

In the banknote handling apparatuses 20, 20*p*, 20*q*, and 20*r* according to the present embodiment and the banknote handling apparatuses 100 and 210 according to the other examples, the curl correction mechanism 70, 170, 270, and the like can be omitted, or the curl correction mechanism 70, 170, 270, and the like can be provided, but a part of the transport unit can be diverted and this part can be bent. In this configuration, the curl habit of the banknote can be corrected by transporting the banknote through the bent part. Specifically, this function can be realized, as shown in FIG. 15, by dividing a transport unit 323 into an upper transport unit 323*a* that is convex up, a lower transport unit 323*b* that is convex down, and a transport unit part 323*c* that is straight. More particularly, assume that the banknote is transported on the transport unit 323 from left to right in FIG. 15 (that is, transported in a direction shown with an arrow in FIG. 15), and that the banknote has a curl habit that is convex down when seen from the direction that is orthogonal to the paper surface of FIG. 15. In this case, the curl of the banknote can be corrected by passing the banknote on the upper transport unit 323*a*. On the other hand, assume that the banknote is transported on the transport unit 323 from left to right in FIG. 15, and that the banknote has a curl habit that is convex up when seen from the direction that is orthogonal to the paper surface of FIG. 15. In this case, the curl of the banknote can be corrected by passing the banknote on the lower transport unit 323*b*. Note that, the straight transport unit part 323*c* is prepared for the banknote having a weak curl habit, or the banknote that does not have a curl habit so as not to apply a curve to such a banknote.

In the banknote handling apparatuses 20, 20*p*, 20*q*, and 20*r* according to the present embodiment and the banknote handling apparatuses 100 and 210 according to the other examples, it is allowable to provide a reversing mechanism that reverses the face side up/back side up of the banknote. In this configuration, after the banknote fed from a certain storing and feeding unit and having the curl habit in a certain direction is reversed by using the reversing mechanism, the banknote can be stored in the storing and feeding unit again. Accordingly, the banknote that has the curl habit in a certain direction can be stored in a state in which the banknote has a curl in the opposite direction of the certain direction, and the curl of the banknote can be corrected.

Note that, the sheet handling apparatus according to the present invention can be used to handle a sheet (for example, a check, a gift certificate, and the like) other than the banknote. In this case, by correcting the curl of the sheet fed from the storing and feeding unit by using the curl correction mechanism, occurrence of a stacking failure of the sheet in the stacking unit can be suppressed.

What is claimed is:

1. A sheet handling apparatus comprising:

a storing and feeding unit in which a sheet is stored on a rotary member by winding the sheet on the rotary member and the sheet wound on the rotary member can be fed from the rotary member;

a transport unit that transports the sheet fed from the storing and feeding unit;

a curl correction mechanism arranged in the transport unit to correct a curl of the sheet transported by the transport unit a stacking unit connected to the transport unit and in which the sheet that has passed through the curl correction mechanism is stacked;

a memory unit storing information regarding at least one of processing contents of the sheet by the sheet handling apparatus; a storing state of the sheet in the storing and feeding unit; and a feature of the sheet fed from the storing and feeding unit; and a control unit that, based on information received from the memory unit, adjusts a degree of correction of the curl of the sheet by the curl correction mechanism.

2. The sheet handling apparatus as claimed in claim 1, wherein the control unit adjusts the degree of correction of the curl of the sheet by the curl correction mechanism by changing a transport speed of the sheet in the transport unit.

3. The sheet handling apparatus as claimed in claim 1, wherein the control unit adjusts the degree of correction of the curl of the sheet by the curl correction mechanism by changing a state of the curl correction mechanism.

4. The sheet handling apparatus as claimed in claim 3, wherein the curl correction mechanism includes a curl correction member capable of contacting with and separating from the sheet transported by the transport unit, and the control unit changes the state of the curl correction mechanism by changing a position of the curl correction member.

5. The sheet handling apparatus as claimed in claim 4, wherein the curl correction member is movable between an operating position at which the curl correction member is nearest to the sheet transported by the transport unit, and a retracted position at which the correction of the curl of the sheet transported by the transport unit is not performed, and the control unit performs a control to perform the correction of the curl of the sheet and not to perform the correction of the curl of the sheet by moving the curl correction member to one of the operating position and the retracted position.

6. The sheet handling apparatus as claimed in claim 1, wherein the storing state of the sheet in the storing and feeding unit includes a state based on a distance from a rotation axis of the rotary member to the stored sheet.

7. The sheet handling apparatus as claimed in claim 6, wherein the control unit increases the degree of correction of the curl of the sheet by the curl correction mechanism when a distance from the rotation axis of the rotary member to the sheet stored in the storing and feeding unit is smaller than a predetermined threshold.

8. The sheet handling apparatus as claimed in claim 1, wherein the storing state of the sheet in the storing and feeding unit includes a state based on a time duration for which the sheet is stored in the storing and feeding unit.

9. The sheet handling apparatus as claimed in claim 1, wherein the feature of the sheet includes at least one factor among a denomination, a short edge length, a long edge length, a thickness, and material of the sheet.

10. The sheet handling apparatus as claimed in claim 1, wherein the stacking unit is one of:

a collecting unit in which can be stacked the sheet that should be collected;

an ejecting unit that ejects the sheet outside of a housing from inside thereof; and an escrow unit for bundling in which the sheet that should be bundled by using a bundling medium is temporarily stacked.

11. The sheet handling apparatus as claimed in claim 10, wherein when a collection process of the sheet is performed, the sheet fed to the transport unit from the storing and feeding unit is sent to the collecting unit after passing the curl correction mechanism.

12. The sheet handling apparatus as claimed in claim 10, wherein the collecting unit is one of a collection bag and a collecting cassette that can be detachably attached to a device body.

13. The sheet handling apparatus as claimed in claim 1, further comprising an inserting unit for inserting the sheet inside a housing from outside thereof, wherein the inserting unit is connected to the transport unit, the sheet inserted from the inserting unit inside the housing from outside thereof is sent to one of the storing and feeding unit and the stacking unit by the transport unit, and the curl correction mechanism is arranged in the transport unit at a position between the storing and feeding unit and the stacking unit.

14. The sheet handling apparatus as claimed in claim 13, wherein:

the control unit adjusts the degree of correction of the curl of the sheet by the curl correction mechanism, as the processing contents of the sheet by the sheet handling apparatus, so that the degree of correction of the curl of the sheet is set higher when transporting by the transport unit the sheet fed to the transport unit from the storing and feeding unit than the degree of correction of the curl of the sheet when transporting by the transport unit the sheet inserted from the inserting unit inside the housing.

15. A sheet handling method comprising:

storing information regarding at least one of processing contents of a sheet by a sheet handling apparatus; a storing state of the sheet in a storing and feeding unit; and a feature of the sheet fed from the storing and feeding unit on a memory unit;

feeding the sheet wound on a rotary member of the storing and feeding unit from the rotary member;

transporting the sheet fed to a transport unit from the storing and feeding unit;

correcting a curl of the sheet transported by the transport unit by using a curl correction mechanism; and stacking the sheet that has passed through the curl correction mechanism in a stacking unit, wherein a degree of correction of the curl of the sheet by the curl correction mechanism is adjusted based on information received from the memory unit.

* * * * *